US009915469B2

(12) United States Patent
Huckaby et al.

(10) Patent No.: US 9,915,469 B2
(45) Date of Patent: Mar. 13, 2018

(54) SYSTEMS, METHODS, AND APPARATUS FOR PROVIDING ASSOCIATED FUNCTIONALITY FOR A REFRIGERATION UNIT

(71) Applicant: Hoshizaki America, Inc., Peachtree City, GA (US)

(72) Inventors: Kevin Huckaby, Newnan, GA (US); Rob McDonald, Newnan, GA (US); Jeremy Neill, Gay, GA (US); Connor McColl, Atlanta, GA (US); Luiz Antonio Lopes, Sharpsburg, GA (US); Donald Pilkey, Brooks, GA (US); Glenn Melton, Fayetteville, GA (US); Bradford Czerwonky, Atlanta, GA (US)

(73) Assignee: Hoshizaki America, Inc., Peachtree City, GA (US)

( * ) Notice: Subject to any disclaimer, the term of this patent is extended or adjusted under 35 U.S.C. 154(b) by 0 days.

(21) Appl. No.: 15/404,815

(22) Filed: Jan. 12, 2017

(65) Prior Publication Data

US 2017/0138660 A1 May 18, 2017

Related U.S. Application Data

(63) Continuation of application No. 14/027,191, filed on Sep. 14, 2013, now Pat. No. 9,581,378.

(Continued)

(51) Int. Cl.

*F25D 25/00* (2006.01)
*F25D 21/14* (2006.01)

(Continued)

(52) U.S. Cl.

CPC ..... *F25D 25/005* (2013.01); *A47F 3/0413* (2013.01); *F25D 17/06* (2013.01);

(Continued)

(58) Field of Classification Search

CPC .... A47F 3/0413; A47F 3/0707; A47F 3/0491; A47F 3/0456; A47F 3/0482; A47F 10/06; A47F 2003/0473

See application file for complete search history.

(56) References Cited

U.S. PATENT DOCUMENTS 1,584,244 A 5/1926 Rabickow
2,181,636 A 11/1939 Saunders (Continued)

OTHER PUBLICATIONS

Czerwonky, Bradford; Issue Notification for U.S. Appl. No. 14/027,191, filed Sep. 14, 2013, dated Feb. 8, 2017, 1 pg.

(Continued)

*Primary Examiner* — Cassey D Bauer
(74) *Attorney, Agent, or Firm* — Taylor English Duma LLP

(57) ABSTRACT

A refrigeration unit includes: a front portion; a rear portion distal from the front portion; a cooling table section extending from the rear portion towards the front portion; an upper portion positioned between the front portion and the rear portion, positioned above the cooling table portion, and defining a circumferential opening configured to receive a storage container; a lower region distal from and below the upper portion and at least partially separated from the upper portion by the cooling table section defining a plenum defining holes allowing passage of air from the plenum of the cooling table section to the upper portion of the refrigeration unit, the lower region configured for food storage; and an evaporator section proximate to the rear portion and configured to circulate air to the cooling table section.

20 Claims, 38 Drawing Sheets

Related U.S. Application Data

(60) Provisional application No. 61/701,227, filed on Sep. 14, 2012.

(51) Int. Cl.

| | |
|---|---|
| ***F25D 17/06*** | (2006.01) |
| ***F25D 23/12*** | (2006.01) |
| ***F25D 23/02*** | (2006.01) |
| ***A47F 3/04*** | (2006.01) |

(52) U.S. Cl.
CPC ..... *F25D 21/14* (2013.01); *F25D 23/026* (2013.01); *F25D 23/12* (2013.01); *F25D 2400/10* (2013.01)

(56) References Cited

U.S. PATENT DOCUMENTS

| | | | |
|---|---|---|---|
| 2,201,265 | A | 5/1940 | Hill |
| 2,508,255 | A | 5/1950 | Hardin |
| 2,741,101 | A | 4/1956 | Trulaske |
| 2,922,546 | A | 1/1960 | Trulaske |
| 3,136,983 | A | 6/1964 | Trulaske |
| D200,029 | S | 1/1965 | Costantini et al. |
| 3,259,184 | A | 7/1966 | Trulaske |
| 3,302,351 | A | 2/1967 | Trulaske |
| 3,328,105 | A | 6/1967 | Trulaske |
| 3,760,535 | A | 9/1973 | Trulaske |
| 4,127,968 | A | 12/1978 | Trulaske |
| D265,316 | S | 7/1982 | Trulaske |
| D271,107 | S | 10/1983 | Trulaske |
| D273,298 | S | 4/1984 | Trulaske |
| D286,730 | S | 11/1986 | Tzifkansky et al. |
| 4,685,311 | A | 8/1987 | Rastelli |
| 4,802,340 | A | 2/1989 | Johnson |
| 4,875,745 | A | 10/1989 | Trulaske |
| 4,890,746 | A | 1/1990 | Trulaske |
| 4,955,486 | A | 9/1990 | Trulaske |
| 5,076,443 | A | 12/1991 | Trulaske |
| 5,168,719 | A | 12/1992 | Branz et al. |
| 5,182,923 | A | 2/1993 | Trulaske |
| 5,182,924 | A | 2/1993 | Trulaske |
| 5,191,769 | A | 3/1993 | Mangini et al. |
| 5,282,367 | A | 2/1994 | Moore et al. |
| 5,363,672 | A | 11/1994 | Moore et al. |
| 5,433,082 | A | 7/1995 | Trulaske |
| D368,483 | S | 4/1996 | Bone |
| D368,484 | S | 4/1996 | Bone |
| 5,553,354 | A | 9/1996 | Trulaske |
| 5,584,547 | A | 12/1996 | Trulaske |
| 5,699,676 | A | 12/1997 | Trulaske |
| 5,704,093 | A | 1/1998 | Trulaske |
| 5,803,560 | A | 9/1998 | Trulaske |
| D400,546 | S | 11/1998 | Trulaske |
| D402,138 | S | 12/1998 | Trulaske |
| 5,937,666 | A | 8/1999 | Trulaske |
| D416,713 | S | 11/1999 | Trulaske |
| D420,367 | S | 2/2000 | Trulaske |
| D421,534 | S | 3/2000 | Trulaske |
| 6,089,036 | A * | 7/2000 | Carlson ..... A47F 3/0447 62/256 |
| 6,109,051 | A | 8/2000 | Majordy |
| 6,151,905 | A | 11/2000 | Smith |
| D438,724 | S | 3/2001 | Trulaske |
| D439,914 | S | 4/2001 | Trulaske |
| D441,990 | S | 5/2001 | Trulaske |
| D443,625 | S | 6/2001 | Vazquez |
| D444,966 | S | 7/2001 | Trulaske |
| D448,589 | S | 10/2001 | Trulaske |
| D452,395 | S | 12/2001 | Trulaske |
| 6,385,990 | B1 | 5/2002 | Lee |
| D461,335 | S | 8/2002 | Trulaske |
| 6,453,694 | B1 | 9/2002 | Trulaske |
| D467,450 | S | 12/2002 | Trulaske |
| 6,523,719 | B2 | 2/2003 | Trulaske |
| 6,564,569 | B1 | 5/2003 | Havens |
| 6,612,124 | B1 | 9/2003 | Hatch et al. |
| 6,792,769 | B2 | 9/2004 | Trulaske |
| 6,941,765 | B2 | 9/2005 | Sung |
| 7,024,878 | B2 | 4/2006 | Trulaske |
| D537,456 | S | 2/2007 | Davis |
| D541,315 | S | 4/2007 | Trulaske |
| 7,243,506 | B2 | 7/2007 | Spillner |
| D552,877 | S | 10/2007 | Trulaske |
| 7,686,405 | B2 | 3/2010 | Trulaske |
| 7,707,846 | B2 | 5/2010 | Trulaske |
| D721,745 | S | 1/2015 | Davis et al. |
| 9,581,378 | B2 | 2/2017 | Czerwonky |
| 2012/0309285 | A1 | 12/2012 | Majordy et al. |
| 2012/0313330 | A1 | 12/2012 | Scalf et al. |
| 2015/0007602 | A1 | 1/2015 | Czerwonky |

OTHER PUBLICATIONS

Continental Refrigerator; Specification Sheet for 27" & 32" Sandwich Unit Refrigerators, publicly available prior to Jan. 12, 2017, 2 pgs.

Czerwonky, Bradford; Non-Final Office Action for U.S. Appl. No. 14/027,191, filed Sep. 14, 2013, dated Jan. 14, 2016, 14 pgs.

Czerwonky, Bradford; Notice of Allowance for U.S. Appl. No. 14/027,191, filed Sep. 14, 2013, dated Oct. 17, 2016, 14 pgs.

Czerwonky, Bradford; Notice of Allowance for U.S. Appl. No. 14/027,191, filed Sep. 14, 2013, dated Jun. 16, 2016, 9 pgs.

Randell; Specification Sheets for Preparation Table Products, publicly available prior to Jan. 12, 2017, 14 pgs.

* cited by examiner

A-A

SYSTEMS, METHODS, AND APPARATUS FOR PROVIDING ASSOCIATED FUNCTIONALITY FOR A REFRIGERATION UNIT

RELATED APPLICATIONS

This application is a continuation of U.S. application Ser. No. 14/027,191, filed Sep. 14, 2013, which issued into U.S. Pat. No. 9,581,378 on Feb. 28, 2017, which claims the benefit of U.S. Provisional Application No. 61/701,227, filed Sep. 14, 2012, all of which are hereby specifically incorporated by reference herein in their entireties.

FIELD OF THE DISCLOSURE

The disclosure relates generally to the field of refrigeration, and more particularly to systems, methods, and apparatus for providing associated functionality for a refrigeration unit.

BACKGROUND

The food service industry serves food from a box-like refrigeration unit having one or more openings to receive pans of food. There can be work surfaces that are approximately waist high that house the pans, and often times, there can be a storage area below for refrigerated or frozen food. There are many factors that give manufacturers trouble in properly maintaining the food temperature not only in the storage area, but also the pans of food ready for service on the work surface. Changing ambient temperatures can also make these units susceptible to improperly maintained temperatures.

BRIEF DESCRIPTION OF THE DISCLOSURE

The disclosure relates to systems, methods and apparatus for providing associated functionality for a refrigeration unit. In one embodiment, a refrigeration unit can include some or all of the following associated functionality: a cooling table plenum, a cross-linking member, a cabinet trim and thermal breaker, a collapsible hood, an internal plenum, an internal bracket, an external rib, an evaporator shroud and condensate drain, and/or a cutting board support bracket.

In one embodiment, a system can include a refrigeration unit; and at least one cooling table plenum operable to mount above an evaporator component and beneath at least one storage container. The at least one cooling table plenum can include an opening operable to receive cooling air and at least one opening in an external wall of the at least one cooling table plenum, wherein at least a portion of the cooling air is directed towards the at least one storage container.

In at least one aspect of an embodiment, a refrigeration unit can include at least one internal circulation bracket that can include an elongated body with a circulating air input opening; and at least one opening in a lateral side of the elongated body, wherein air is input to the circulating air input opening and at least a portion of the air circulates through the elongated body and through the at least one opening in the lateral side of the elongated body.

In at least one aspect of an embodiment, a refrigeration unit can include a cross-linking structure operable to support one or more storage containers within or above the refrigeration unit.

The refrigeration unit can also include one or more winglets mounted to the cross-linking structure, the one or more winglets operable to restrict placement of the one or more storage containers with respect to the cross-linking structure.

In at least one aspect of an embodiment, a refrigeration unit can include a cabinet trim with a thermal breaker. The cabinet trim with a thermal breaker can include a broad external body, and a narrower internal body mounted to a portion of the broad external body, wherein the narrower internal body comprises at least two legs extending perpendicularly from the broad external body.

In at least one aspect of an embodiment, a refrigeration unit can include a collapsible hood. The collapsible hood can include a sloped door with at least one angled lateral side, at least one lateral hood sidewall, a horizontal hood upper wall, and a rear wall.

In at least one aspect of an embodiment, a refrigeration unit can include an internal circulation plenum. The internal circulation plenum can include an evaporator air circulation plenum, a cooling table plenum, one or more plenums between one or more food containers disposed above the cooling table plenum, and a lower refrigeration unit plenum, wherein air circulating within the internal circulation plenum travels from the evaporator air circulation plenum to the cooling table plenum to the one or more plenums between one or more food containers disposed above the cooling table plenum and to the lower refrigeration unit plenum.

In at least one aspect of an embodiment, a refrigeration unit can include a base operable to mount to a lower portion of the refrigeration unit, and an elongated rib operable to mount to the base to divide an area beneath the refrigeration unit into at least two separate areas, wherein air flow in one separate area is maintained separate from air flow in the other separate area.

In at least one aspect of an embodiment, a refrigeration unit can include a condensate drain pan operable to collect condensate and direct the collected condensate towards an opening in the condensate drain pan, and an evaporator fan shroud operable to direct condensate from an evaporator component towards the condensate drain pan.

In at least one aspect of an embodiment, a refrigeration unit can include at least one cutting board support bracket. The at least one cutting board support can include an upper cutting board support surface operable to support an upper portion of a cutting board, a lower cutting board support surface operable to support a lower portion of a cutting board, and a stop device operable to limit travel of the cutting board with respect to the cutting board support bracket.

Some embodiments of the disclosure can have other aspects, elements, features, operations, acts, and steps in addition to or in place of what is described above. These potential additions and replacements are described throughout the rest of the specification.

In one aspect, disclosed is a refrigeration unit comprising: a front portion; a rear portion distal from the front portion; a cooling table section extending horizontally from the rear portion towards the front portion; an upper portion positioned between the front portion and the rear portion, positioned above the cooling table portion, and defining a circumferential opening configured to receive a plurality of storage containers; a lower region distal from and below the upper portion and positioned below the cooling table section, the lower region configured for food storage; a door positioned proximate to the front portion and configured to give a user selective access to both the upper portion and the lower region, the lower region in communication with the upper portion by a plenum defined between a front edge of the cooling table section and the door of the refrigeration unit when the door is closed; and an evaporator section proximate to the rear portion and configured to deliver air to the cooling table section; wherein the cooling table section comprises an upper cooling table component and a lower cooling table component in parallel orientation to the upper cooling table component, the upper cooling table component and the lower cooling table component defining a plenum; the upper cooling table component defining a plurality of holes allowing passage of air from the plenum of the cooling table section to the upper portion of the refrigeration unit.

In a further aspect, disclosed is a refrigeration unit comprising: a front portion; a rear portion distal from the front portion; a cooling table section extending from the rear portion towards the front portion; an upper portion positioned between the front portion and the rear portion, positioned above the cooling table portion, and defining a circumferential opening configured to receive a storage container; a lower region distal from and below the upper portion and at least partially separated from the upper portion by the cooling table section defining a plenum defining holes allowing passage of air from the plenum of the cooling table section to the upper portion of the refrigeration unit, the lower region configured for food storage; and an evaporator section proximate to the rear portion and configured to circulate air to the cooling table section.

In yet another aspect, disclosed is a method of using a refrigeration unit the method comprising: powering on the refrigeration unit, the refrigeration unit comprising: a front portion; a rear portion distal from the front portion; a cooling table section extending horizontally from the rear portion towards the front portion, the cooling table section comprising an upper cooling table component and a lower cooling table component in parallel orientation to the upper cooling table component, the upper cooling table component and the lower cooling table component defining a plenum; the upper cooling table component defining holes allowing passage of air from the plenum of the cooling table section to the upper portion of the refrigeration unit; an upper portion positioned between the front portion and the rear portion, positioned above the cooling table portion, and defining a circumferential opening configured to receive a plurality of storage containers; a lower region distal from and below the upper portion and positioned below the cooling table section, the lower region configured for food storage; and an evaporator section proximate to a rear portion and configured to deliver air to the cooling table section; circulating air from the evaporator section into the plenum of the cooling table section; and forcing air from the plenum of the cooling table section to the upper portion of the refrigeration unit through the holes defined in the upper cooling table component and towards a plurality of storage containers positioned within the circumferential opening of the upper portion.

BRIEF DESCRIPTION OF THE DRAWINGS

The detailed description is set forth with reference to the accompanying drawings. The use of the same reference numerals indicates similar or identical components or elements; however, different reference numerals may be used as well to indicate components or elements which may be similar or identical. Various embodiments of the disclosure may utilize elements and/or components other than those illustrated in the drawings, and some elements and/or components may not be present in various embodiments. Depending on the context, singular terminology used to describe an element or a component may encompass a plural number of such elements or components and vice versa.

DETAILED DESCRIPTION OF CERTAIN EMBODIMENTS

Figure 1:
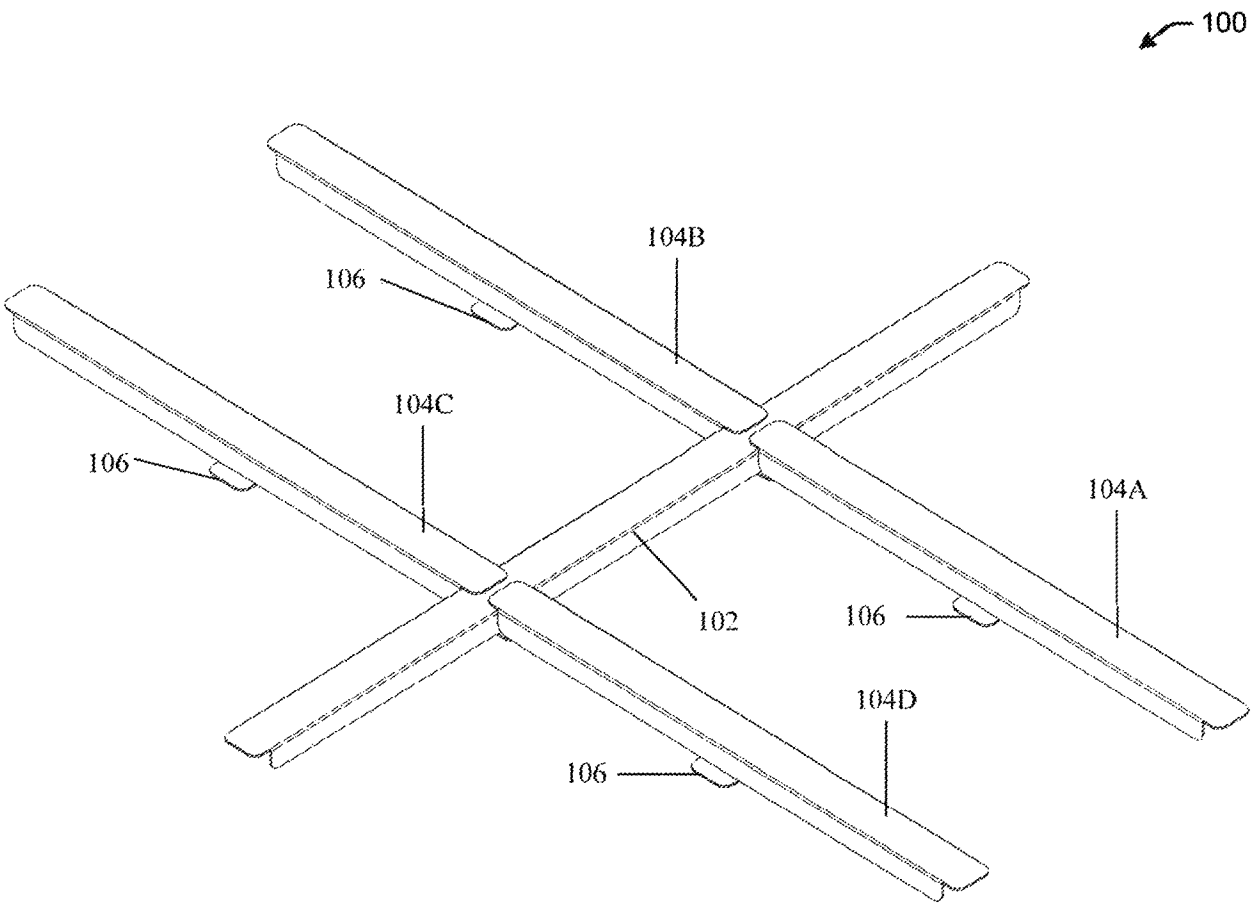
FIGS. 1-6 illustrate various views of an example cross-linking member for a refrigeration unit according to certain embodiments of the disclosure.
Figure 2:
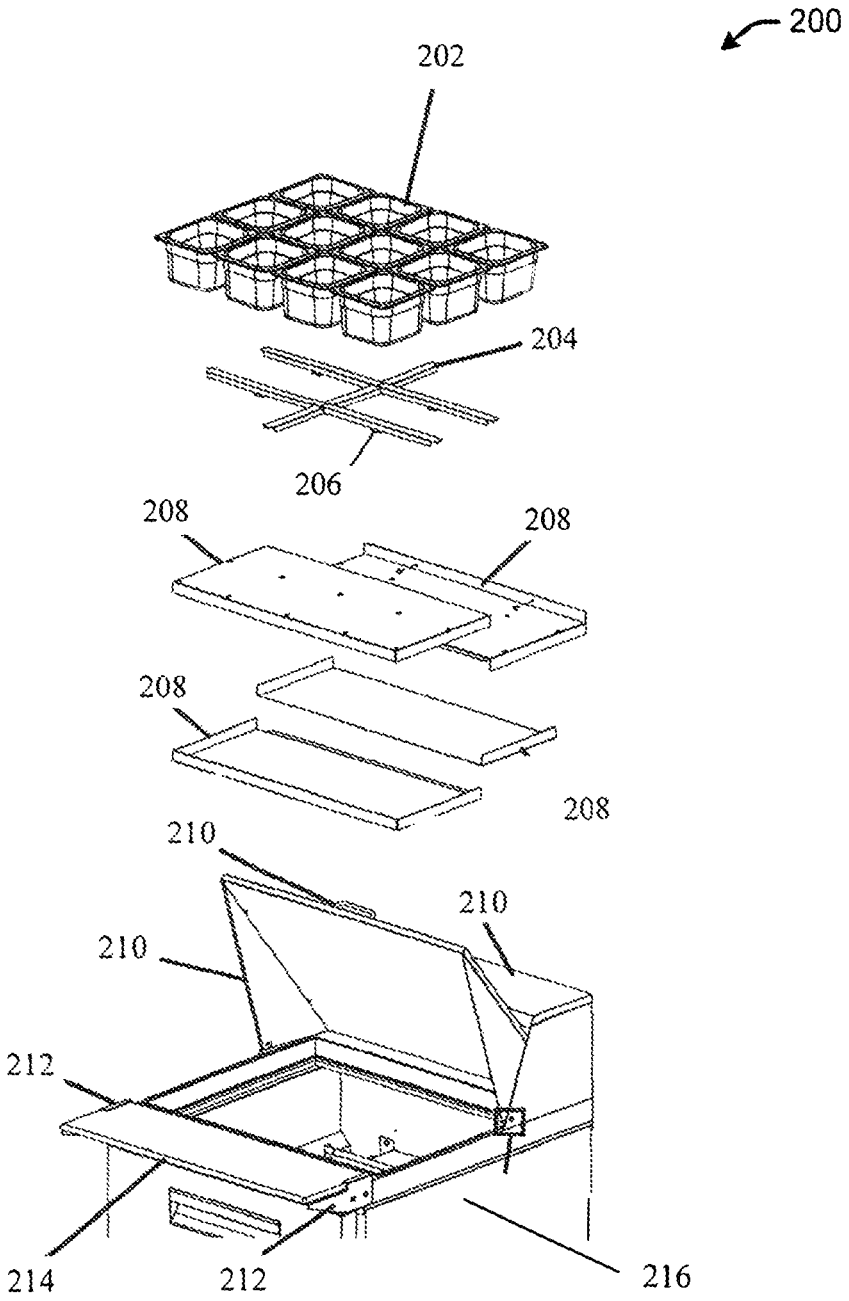
Figure 3:
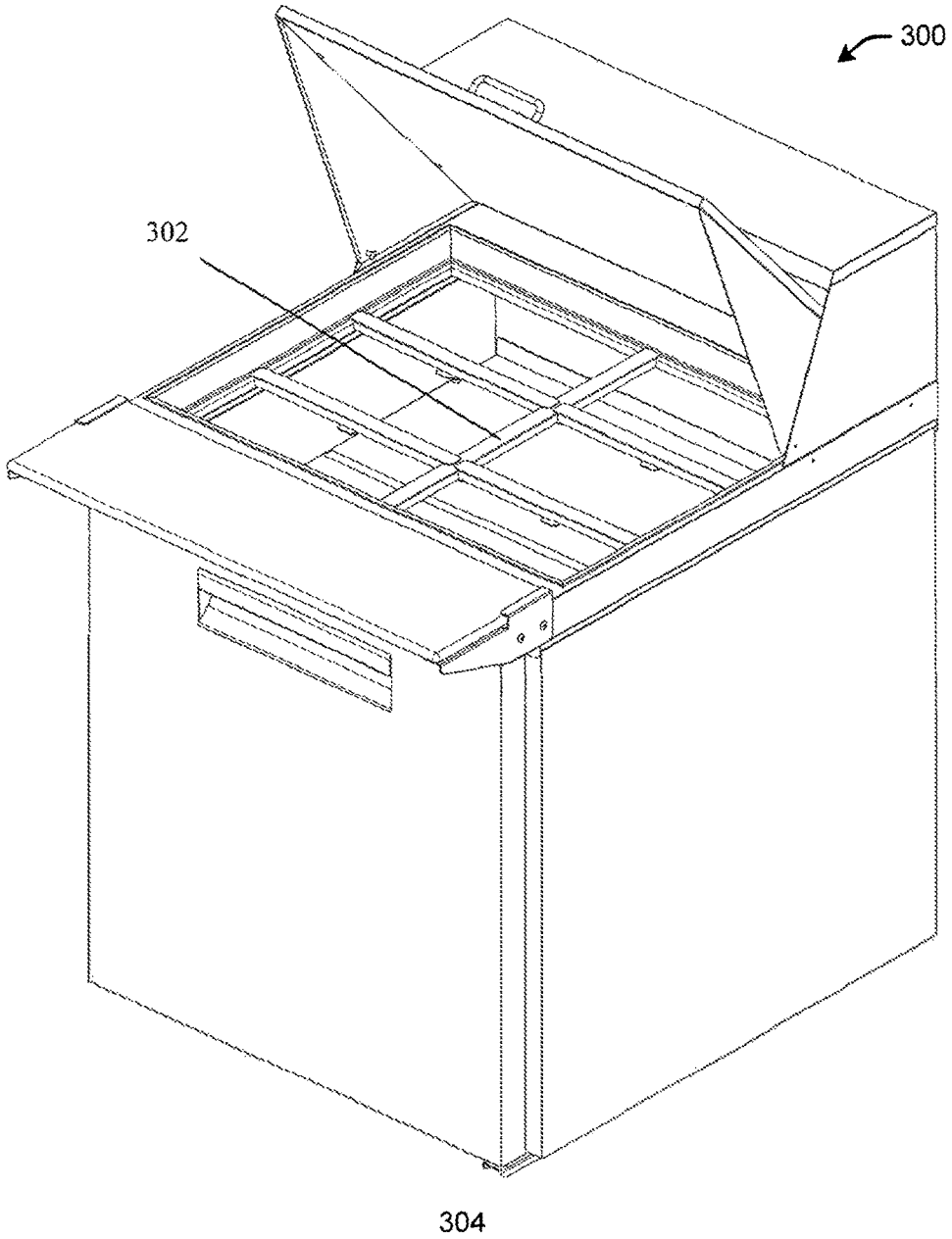
Figure 4:
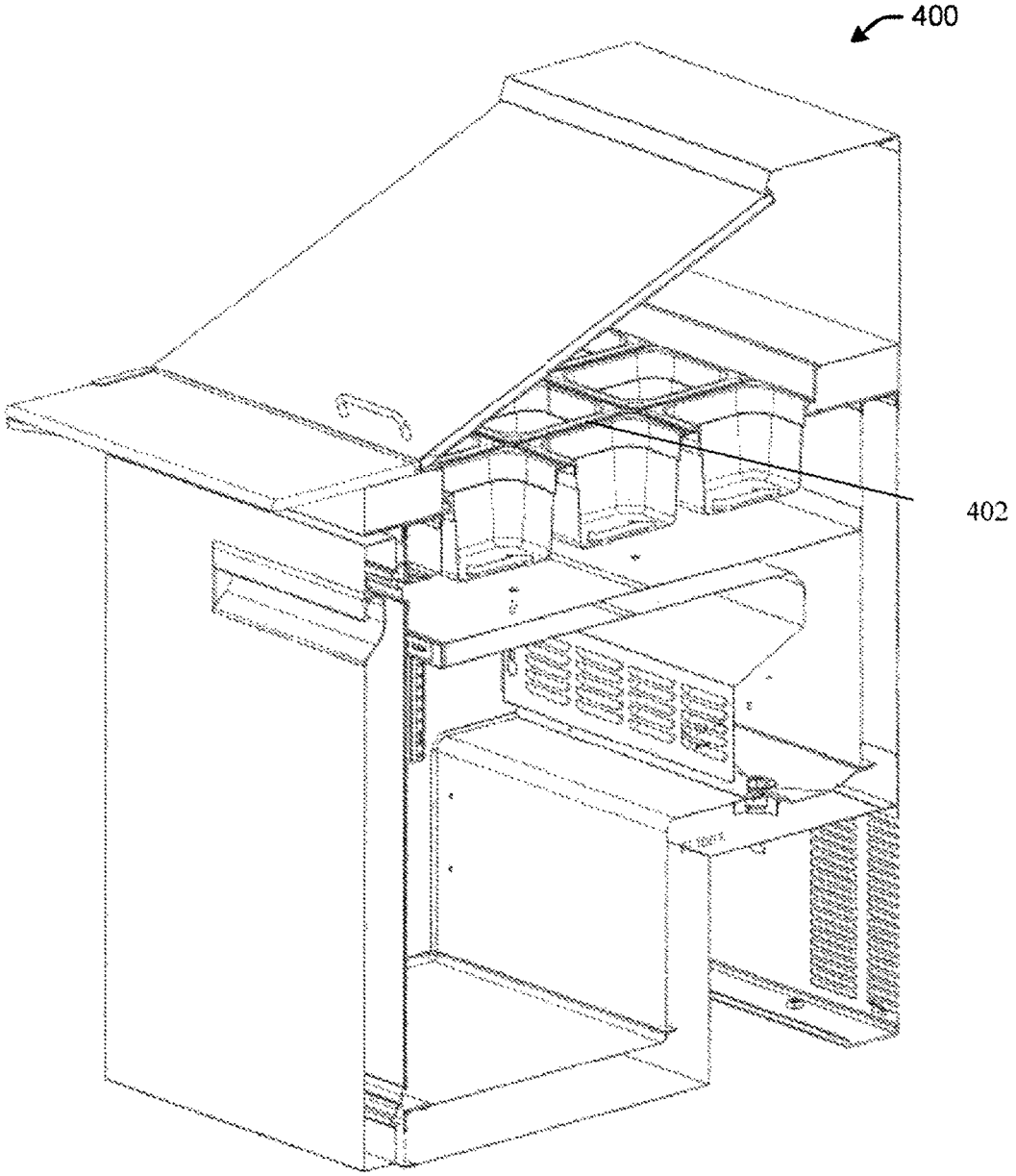
Figure 5:
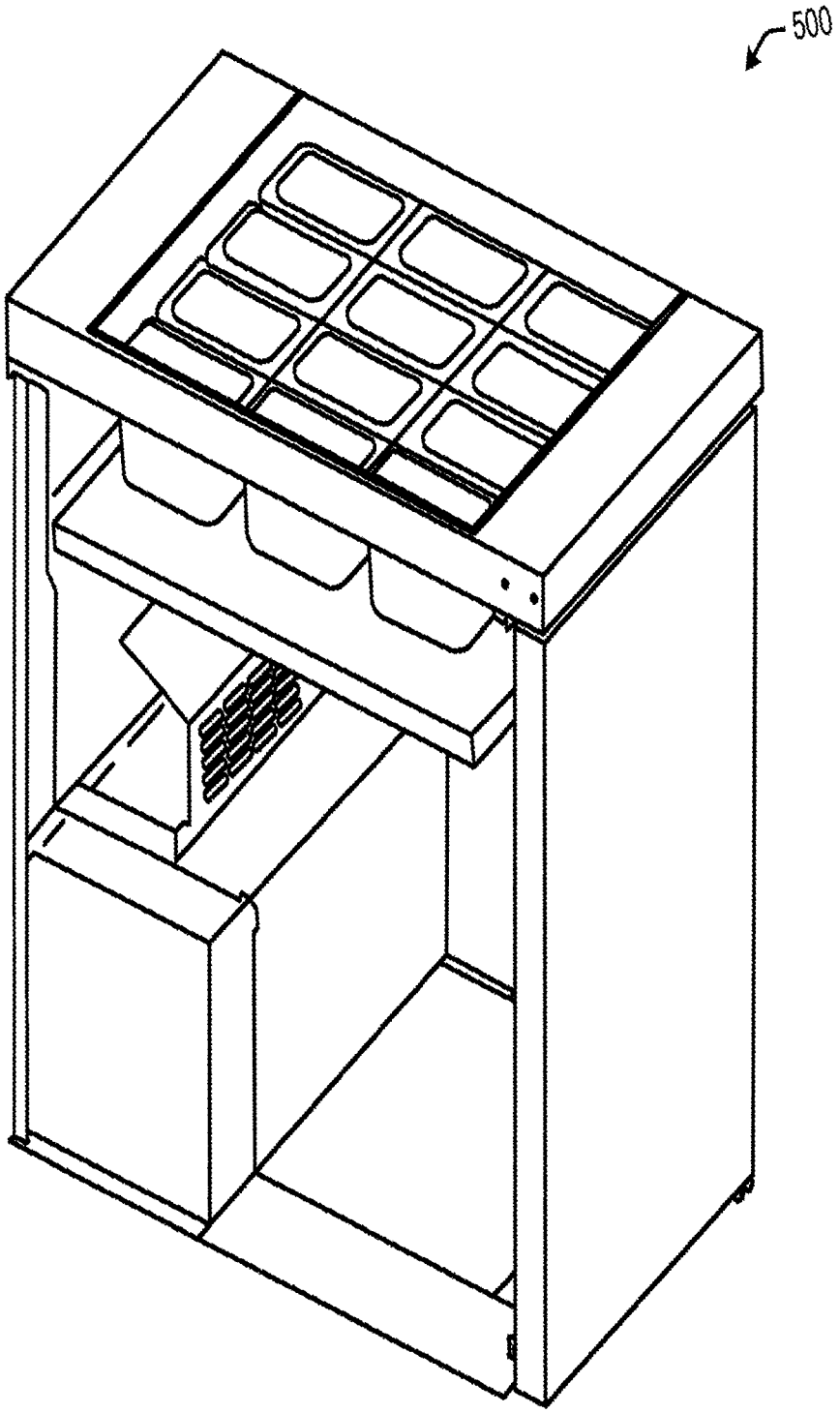
Figure 6:
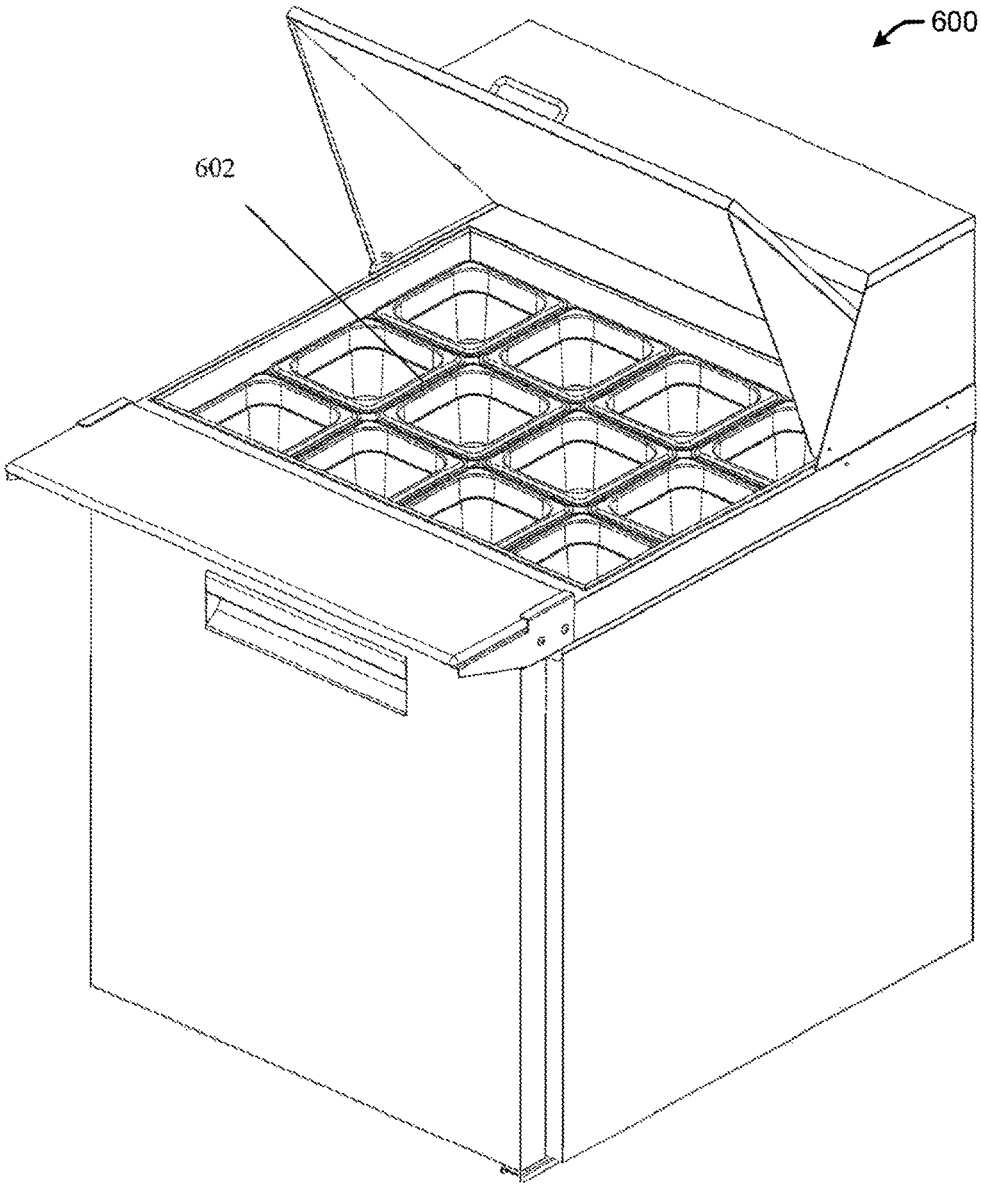

Certain embodiments of the disclosure will now be described more fully hereinafter with accompanying drawings and corresponding description in FIGS. 1-27. This disclosure may, however, be embodied in many different forms and should not be construed as limited to the embodiments set forth herein.

Overview

The disclosure relates to systems, methods, and apparatus for providing associated functionality for a refrigeration unit.

In one example implementation, a cross-linking structure can be mounted in an upper portion of a cooling chamber for a refrigeration unit according to certain embodiments of the disclosure. The cross-linking structure can be operable to support one or more storage containers in the upper portion of the cooling chamber of the refrigeration unit. The cross-linking linking structure can include at least one central member with a plurality of perpendicularly oriented relatively shorter members extending away from the at least one central member. For example, a series of 2 relatively shorter members can be spaced apart from each other and mounted on one lateral side of the at least one central member, and 2 other relatively shorter members can be spaced apart from each other and mounted on an opposing lateral side of the at least one central member. A series of respective winglets can be mounted to a lower portion of each of the relatively short members to provide positive stops to use certain sizes of storage containers with the cross-linking structure.

In another example implementation, a cabinet trim and thermal breaker can be mounted in an upper circumferential opening or cavity for a refrigeration unit according to certain embodiments of the disclosure. The cabinet trim and thermal breaker can include a relatively broad external body and a relatively narrower internally mounted body. The relatively narrower internally mounted body can be operable to be inserted within an upper circumferential opening or cavity for a refrigeration unit. The relatively narrower internally mounted body can include a generally internally angled shape with any number of optional outward lateral protrusions. The generally internally angled shape can be operable to assist with guiding and installing the cabinet trim and thermal breaker into the opening or cavity during installation, and the optional outward lateral protrusions can be operable to maintain the position of the cabinet trim and thermal breaker when installed within the opening or cavity. In some instances, the configuration of the relatively broad external body and/or relatively narrower internally mounted body can maintain the position of the cabinet trim and thermal breaker when installed within the opening or cavity.

In another example implementation, a modularized collapsible hood can be mounted on an upper surface of a refrigeration unit according to certain embodiments of the disclosure. The hood can be configured in multiple parts, some or all of which can be used for different sized models and/or types of the refrigeration unit.

In another example implementation, an internal circulation plenum can be configured within a refrigeration unit according to certain embodiments of the disclosure. The internal circulation plenum can be operable to circulate air from a lower region of the refrigeration unit to an evaporator section, and then through a table section. The table section can direct the air between one or more storage containers positioned in an upper portion of the refrigeration unit. Air is recirculated from the upper portion downward from the front portion of the refrigeration unit towards the rear portion beneath the table section.

In another example implementation, an internal circulation bracket can be configured within a refrigeration unit according to certain embodiments of the disclosure. The internal circulation bracket can be a generally hollow bracket operable to circulate relatively cooler air from one end to an opposing end of the bracket. One or more circulation holes or openings can be machined in one or more lateral sides of the bracket to permit cooling air to pass through the bracket surfaces. The bracket can be manipulated or otherwise moved from one location to another location within a refrigeration unit to create air circulation channels between one or more storage containers mounted or otherwise supported in an upper portion of the refrigeration unit.

In another example implementation, a rib operable to prevent or minimize short circuiting can be mounted to a lower external surface of a refrigeration unit according to certain embodiments of the disclosure. The rib can extend from a front portion of the refrigeration unit to a rear portion of the refrigeration unit, and extend substantially perpendicularly away from the external surface of the refrigeration unit. The air space on one side of the rib can generally be maintained separately from the air space on the other side of the rib.

In another example embodiment, an evaporator shroud and condensate drain for a refrigeration unit can be provided according to certain embodiments of the disclosure. The evaporator shroud can be operable to enclose at least a portion of an evaporator component associated with a refrigeration unit. The evaporator shroud can be shaped to generally conform with the shape of the evaporator component and to generally direct some or all of any condensate from the evaporator component towards an associated condensate drain. The condensate drain can be a pan-shaped component, separate from the evaporator shroud and evaporator component, that can receive condensate directed towards it from the evaporator shroud, and further direct some or all of the condensate towards an opening or hole in the drain.

In another example embodiment, a cutting board support bracket can be mounted to an upper portion of a refrigeration unit according to certain embodiments of the disclosure. The cutting board support bracket can be operable to support the cutting board generally horizontal and parallel with respect to an upper portion, such as an upper surface, of the refrigeration unit.

The exemplary implementations and embodiments shown and described herein in FIGS. 1-27 can provide systems, methods, and apparatus for providing associated functionality for a refrigeration unit. The implementations and embodiments described herein may have different structural components according to various embodiments and implementations as described herein. Certain embodiments of the disclosure can provide technical solutions for improving unit efficiency, decreasing power consumption compared to conventional refrigeration units, and improving user flexibility and ease of operation.

FIGS. 1-6 illustrate various views of an example cross-linking structure for a refrigeration unit according to certain embodiments of the disclosure. The crosslinking structure 100 shown in the perspective view of FIG. 1 can be operable to support one or more storage containers in the upper portion of the cooling chamber of a refrigeration unit. The cross-linking structure 100 can include at least one elongated central member 102 with a plurality of perpendicularly oriented relatively shorter elongated members 104A, 104B, 104C, 104D extending away from the at least one elongated central member 102. For example, a series of 2 relatively shorter elognated members 104A, 104D can be spaced apart from each other and mounted on one lateral side of the at least one elongated central member 102, and 2 other relatively shorter elongated members 104B, 104C can be spaced apart from each other and mounted on an opposing lateral side of the at least one central member. A series of respective rectangular tab-shaped winglets 106 can be mounted to a lower portion of each of the relatively shorter elongated members 104A, 104B, 104C, 104D to provide positive stops to use certain sizes of storage containers with the cross-linking structure 100. In the example shown, the winglets 106 are generally spaced about midway along the length of each relatively shorter elongated member 104A, 104B, 104C, 104D, such that equally sized storage containers can be accommodated by and supported by the cross-linking structure 100.

In some embodiments, the winglets, such as 106, can be removably mounted to the relatively shorter elongated members, such as 104A, 104B, 104C, 104D, and can be moved to different locations along the length of each short member to accommodate different sizes of storage containers supported by the cross-linking structure 100. In other embodiments, different shaped and/or sized winglets can be used with a cross-linking structure 100. In certain embodiments, some or all of the winglets, such as 106, may be fixed with respect to the relatively shorter elongated members, such as 104A, 104B, 104C, 104D, of the crosslinking structure 100. In certain embodiments, one or more additional winglets and/or similar support structures can be used to obtain suitable alignment of the storage containers.

Turning to FIGS. 2-6, example orientations and/or configurations of a cross-linking structure, similar to 100 in FIG. 1, within a refrigeration unit are shown according to several embodiments of the disclosure. For example, the system 200 in the exploded view of FIG. 2 can include one or more storage containers 202 mounted to a cross-linking structure 204 with one or more winglets 206, one or more cooling table components 208, one or more collapsible hood components 210, a cutting board support bracket 212, a cutting board 214, and a refrigeration unit 216. Some or all of the functionality associated with the one or more cooling table components 208, one or more collapsible hood components 210, a cutting board support bracket 212, a cutting board 214, and/or the refrigeration unit 216 are further described below. In other examples, such as 300, 400, 500, and 600 of the perspective views of FIGS. 3, 4, 5, and 6, respectively, similar and/or different sizes and shapes of a cross-linking structure 302, 402, 602 can be used to support storage containers with respect to a refrigeration unit.

In the manner described above, the cross-linking structure can provide novel ways of supporting storage containers, such as food pans, in a refrigeration unit or with an associated refrigerated preparation table.

In FIGS. 7A-12, examples are shown of a cabinet trim and thermal breaker for a refrigeration unit according to certain embodiments of the disclosure. Generally, as shown in the refrigeration unit 700 of the perspective view of FIG. 7A, a cabinet trim and thermal breaker 702 can be mounted in an upper circumferential opening 704 or cavity along an upper edge 706 or surface of the refrigeration unit 700 according to certain embodiments of the disclosure. The cabinet trim and thermal breaker 702 of FIGS. 7A and 7C can include a relatively broad external body 708 and a relatively narrower internally mounted body 710. As seen in the cutaway side view of FIG. 7C, the relatively narrower internally mounted body 710 can be operable to be inserted within the upper circumferential opening 704 or cavity of the refrigeration unit 700. The relatively narrower internally mounted body 710 can include a generally internally angled shape 712 with any number of optional outward lateral protrusions. In the example shown, an outer leg 714 and an inner leg 716 can extend from the relatively broad external body 708, wherein a wall 718 or portion of the refrigeration unit can be disposed between the outer leg 714 and an inner leg 716. The generally internally angled shape 712 can be operable to assist with guiding and installing the cabinet trim and thermal breaker 702 into the opening 704 or cavity during installation, and the optional outward lateral protrusions can be operable to maintain the position of the cabinet trim and thermal breaker 702 when installed within the opening 704 or cavity. In some instances, the configuration of the relatively broad external body 708 and/or relatively narrower internally mounted body 710 can maintain the position of the cabinet trim and thermal breaker when installed within the opening or cavity.

Figure 7A:
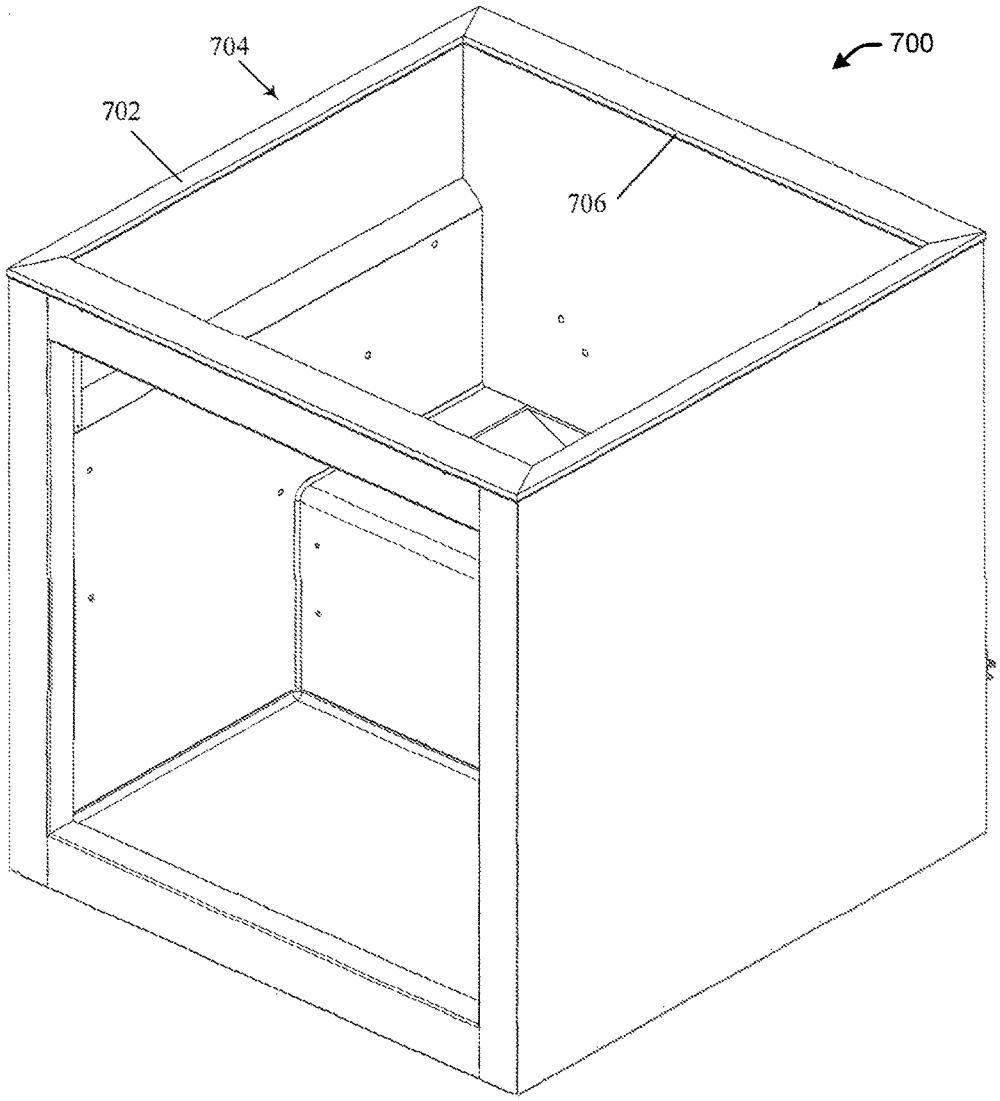
FIGS. 7A, 7B, 7C, 8, 9A, 9B, 10, 11, 12A, and 12B illustrate example cabinet trims and thermal breakers for a refrigeration unit according to certain embodiments of the disclosure.
Figure 7B:
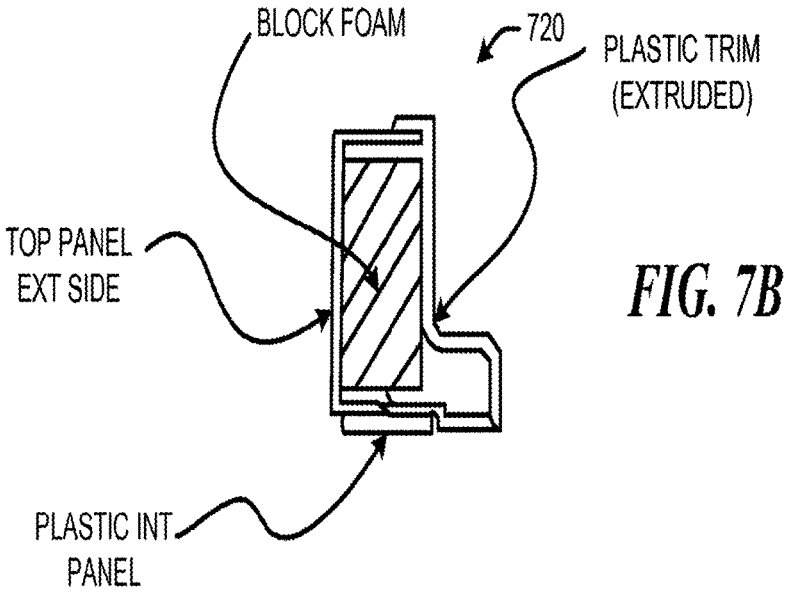
Figure 7C:
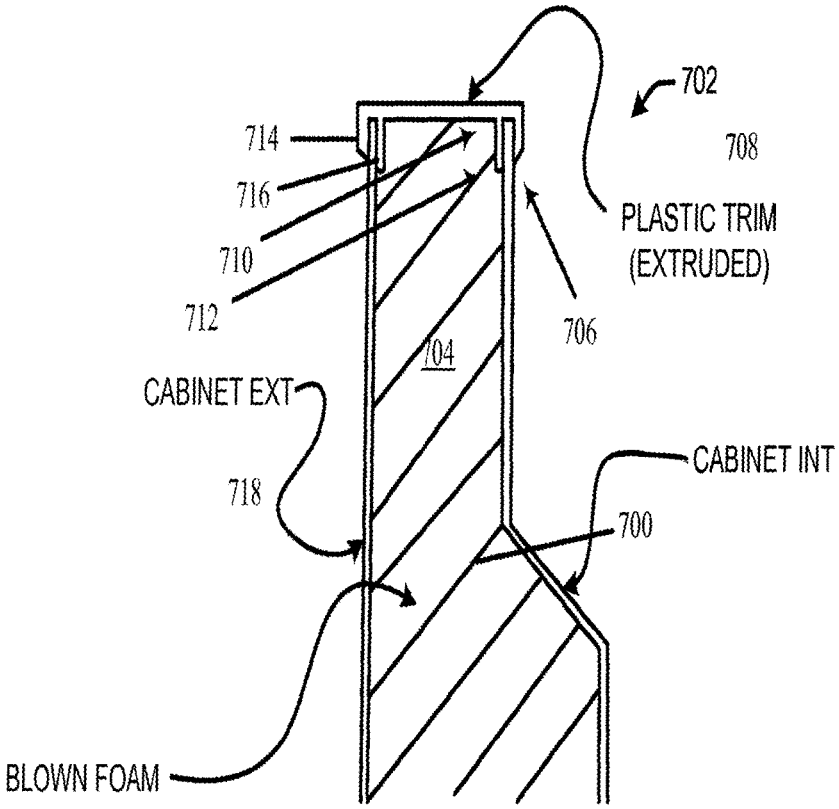

The cabinet trim and thermal breaker 720 shown in the cutaway side view of FIG. 7B can be an associated component of the cabinet trim and thermal breaker shown in FIGS. 7A and 7C. In the embodiment shown in FIG. 7B, a similar type of mode of installation can be used for a different size opening or cavity or other opening or cavity along an upper edge or surface of the refrigeration unit 700.

Figure 8:
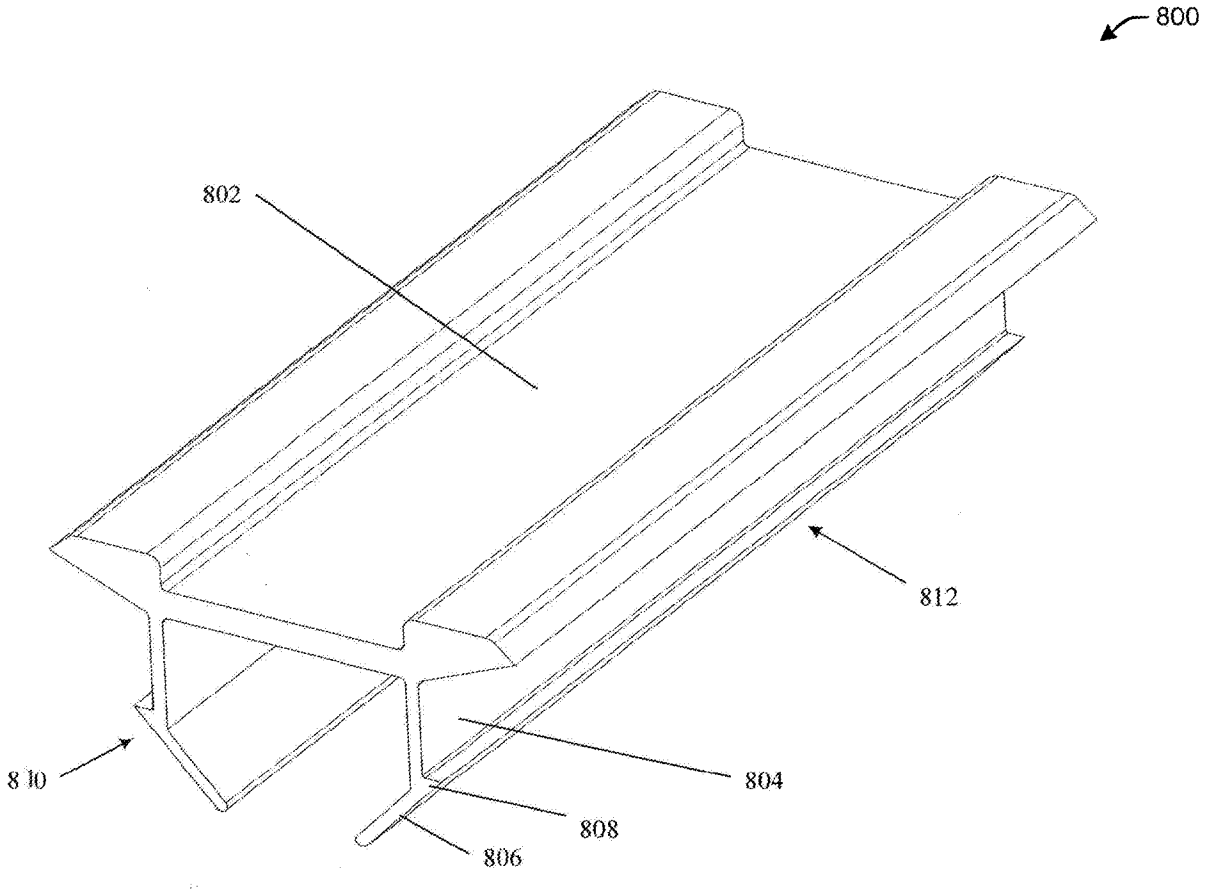
Figure 9B:
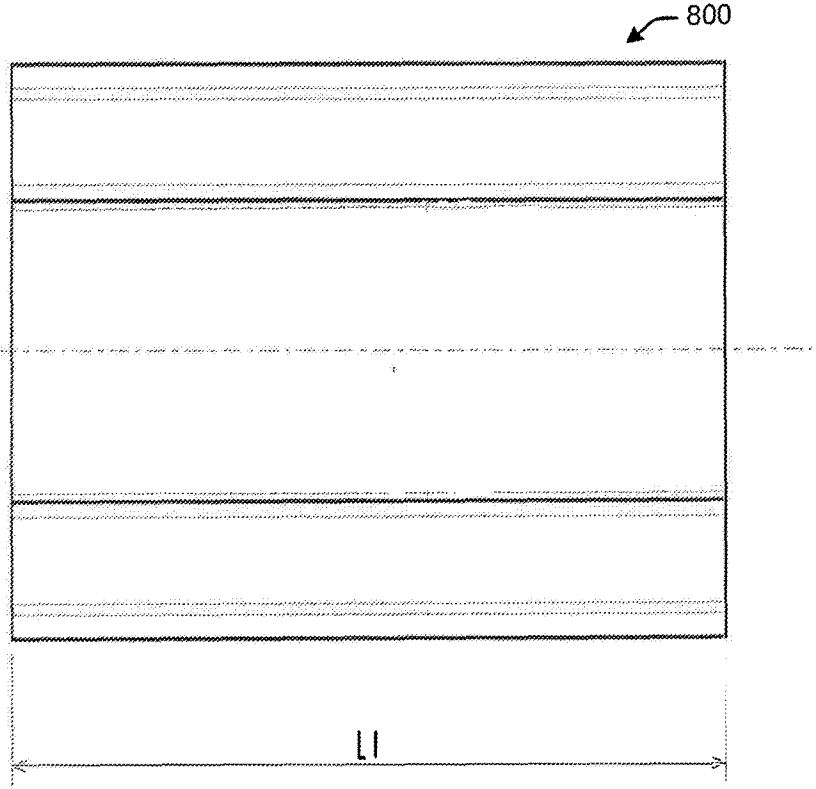
Figure 9A:
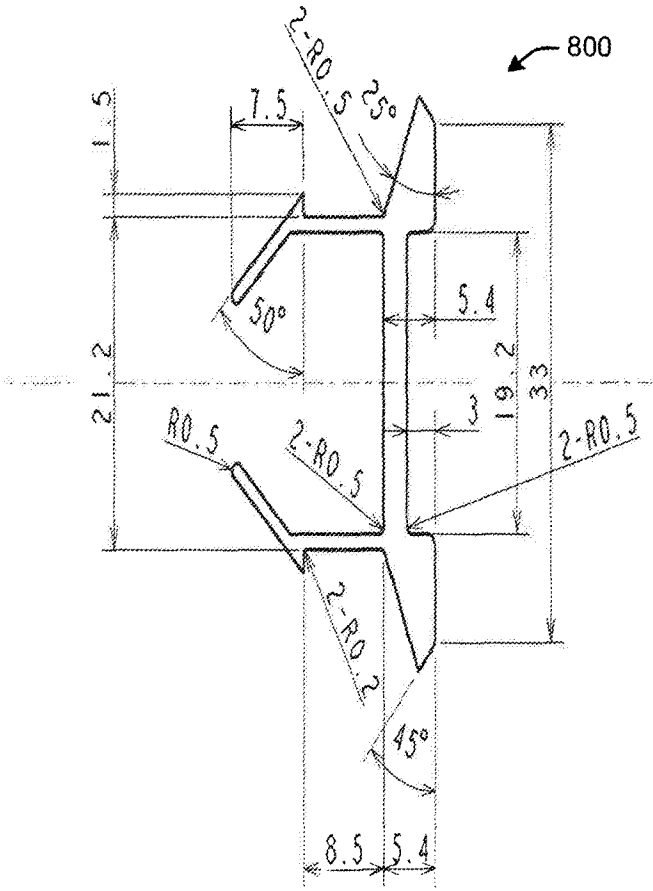
Figure 10:
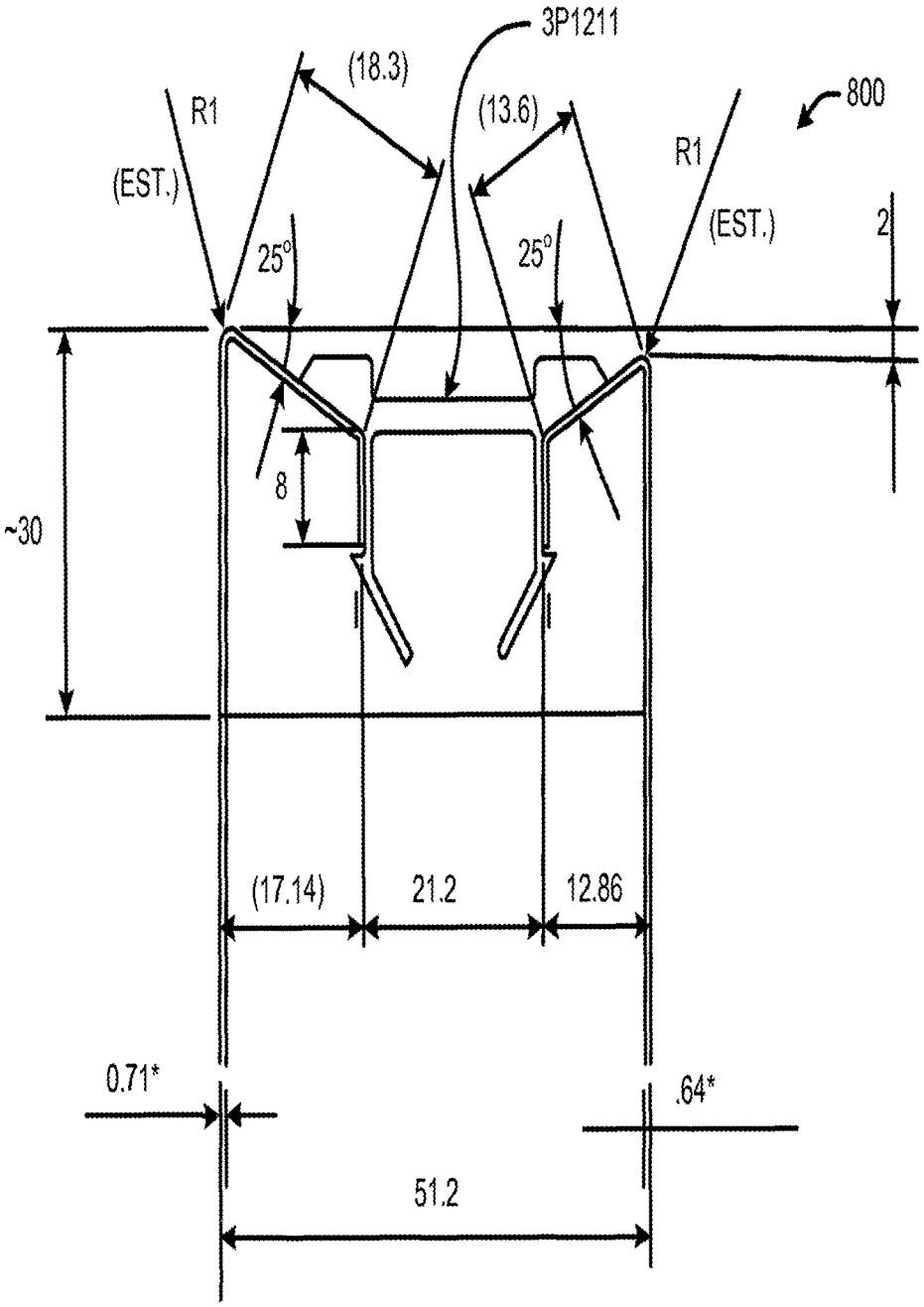
Figure 11:
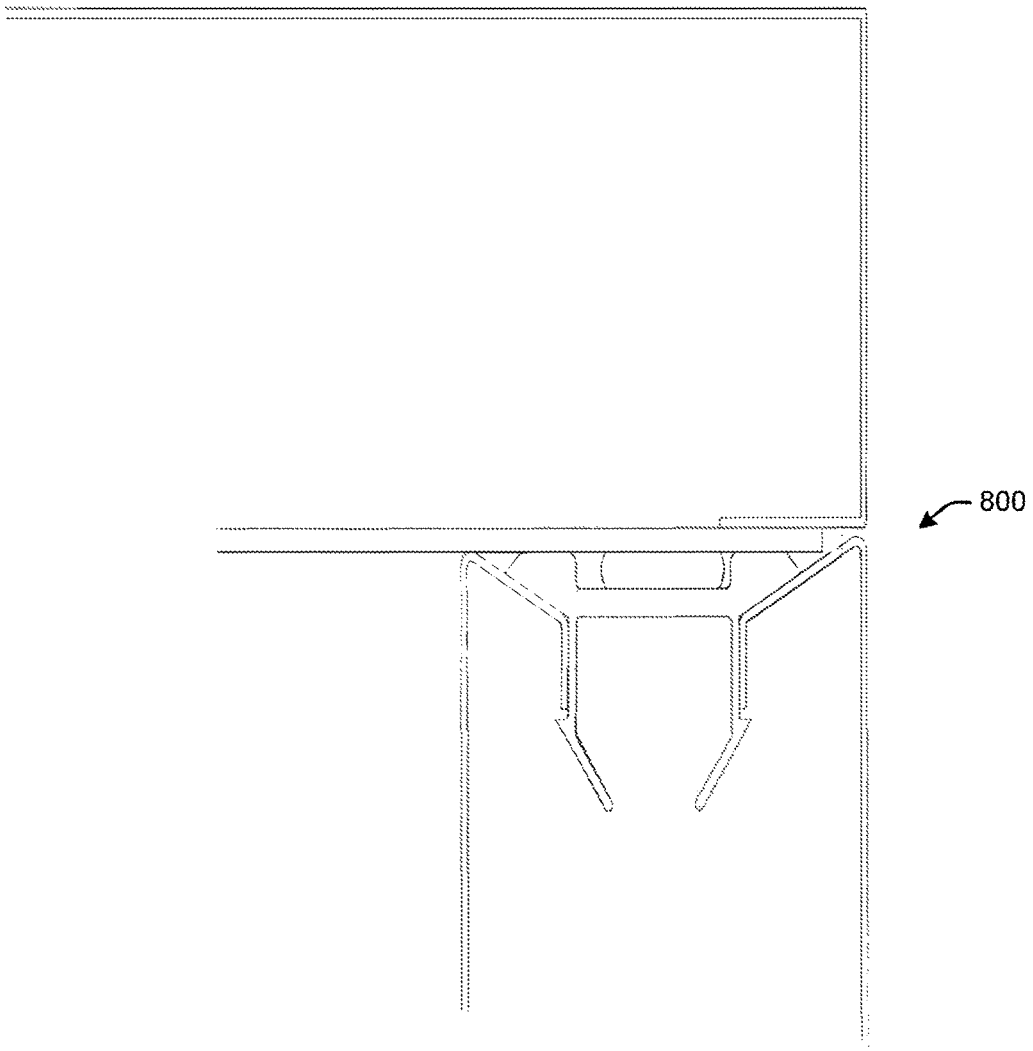

Another example cabinet trim and thermal breaker 800 is shown in FIGS. 8, 9A, 9B, 10, and 11 according to certain embodiments of the disclosure. For example, in the perspective view of FIG. 8, the cutaway side view of FIG. 9A, the overhead view of FIG. 9B, and the side views of FIGS. 10 and 11, the cabinet trim and thermal breaker 800 shown can include a relatively broad external body 802 and a relatively narrower internally mounted body 804. The relatively narrower internally mounted body 804 can be operable to be inserted within the upper circumferential opening, similar to 704 in FIGS. 7 A and 7C, or cavity of the refrigeration unit, similar to 700. The relatively narrower internally mounted body 804 can include a generally internally angled body 806 with any number of optional outward lateral protrusions 808. In the example shown, the relatively narrower internally mounted body 804 can include a first leg 810 and an opposing or second leg 812, both of which can extend from the relatively broad external body 802, wherein the first leg 810 is angled towards the opposing or second leg 812, and the opposing or second leg 812 is angled towards the first leg 810. The generally internally angled body 806 can be operable to assist with guiding and installing the cabinet trim and thermal breaker 800 into the opening or cavity during installation, and the optional outward lateral protrusions 808 can be operable to maintain the position of the cabinet trim and thermal breaker 800 when installed within the opening or cavity. Example dimensions of a cabinet trim and thermal breaker 800 of FIG. 8, are illustrated in the cutaway side view of FIG. 9A. Example dimensions of an associated refrigeration unit, similar to 700, with an installed cabinet trim and thermal breaker 800 are shown in the side view of FIG. 10.

Figure 12B:
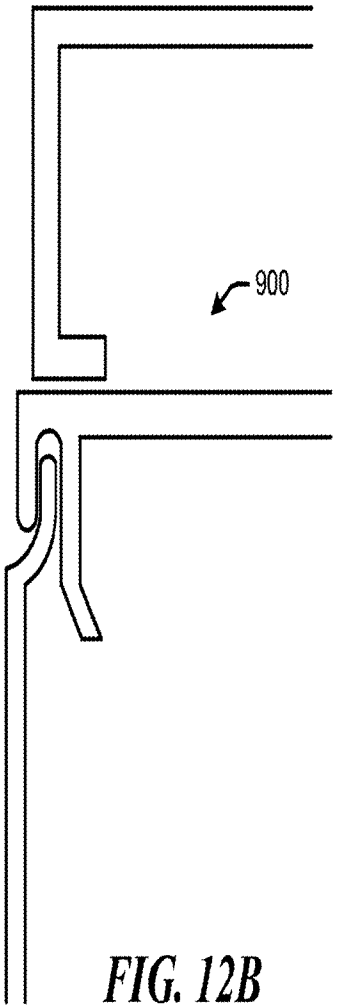
Figure 12A:
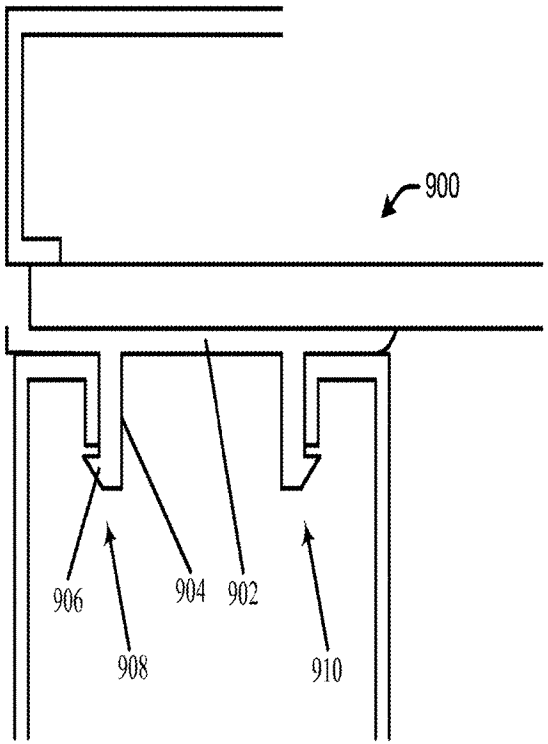

FIGS. 12A and 12B illustrate another example cabinet trim and thermal breaker 900 according to certain embodiments of the disclosure. In this embodiment, as seen in the side view of FIG. 12A, the cabinet trim and thermal breaker 900 can include a relatively broad external body 902 and a relatively narrower internally mounted body 904, and the relatively narrower internally mounted body 904 can be operable to be inserted within the upper circumferential opening, similar to 704 in FIGS. 7 A and 7C, or cavity of the refrigeration unit. However, the relatively narrower internally mounted body 904 may be relatively straight or otherwise perpendicular to the lower surface of the relatively broad external body 902. The relatively narrower internally mounted body 904 can also include any number of optional outward lateral protrusions 906. In the example shown, the relatively narrower internally mounted body 904 can include a first leg 908 and an opposing or second leg 910, both of which can extend substantially perpendicularly from the relatively broad external body 902, wherein the first leg 908 is substantially parallel with the opposing or second leg 910. In this instance, the configuration of the relatively broad external body 902 and/or the relatively narrower internally mounted body 904 and the optional outward lateral protrusions 906 can maintain the position of the cabinet trim and thermal breaker when installed within the opening or cavity.

As seen in another side view of FIG. 12B, the cabinet trim and thermal breaker 900 can include a different configuration at another portion, such as at an adjacent wall or edge of the refrigeration unit. In this example, the cabinet trim and thermal breaker 900 can have a similar configuration as shown and described with respect to FIG. 7C.

In any instance, in certain embodiments, a refrigeration unit can utilize a cabinet trim with a thermal breaker to connect one or more interior and exterior lateral surfaces of the unit while providing a more adequate or suitable insulation between the surfaces. This trim can support the mounting of one or more storage containers, such as food storage pans, from the lateral surfaces of a refrigeration unit in a way to facilitate a relatively low manufacturing cost. In some instances, a cabinet trim with a thermal breaker according to certain embodiments of the disclosure can facilitate a variety of different storage container configurations and provide more alternatives to use different sized storage containers.

Figure 13:
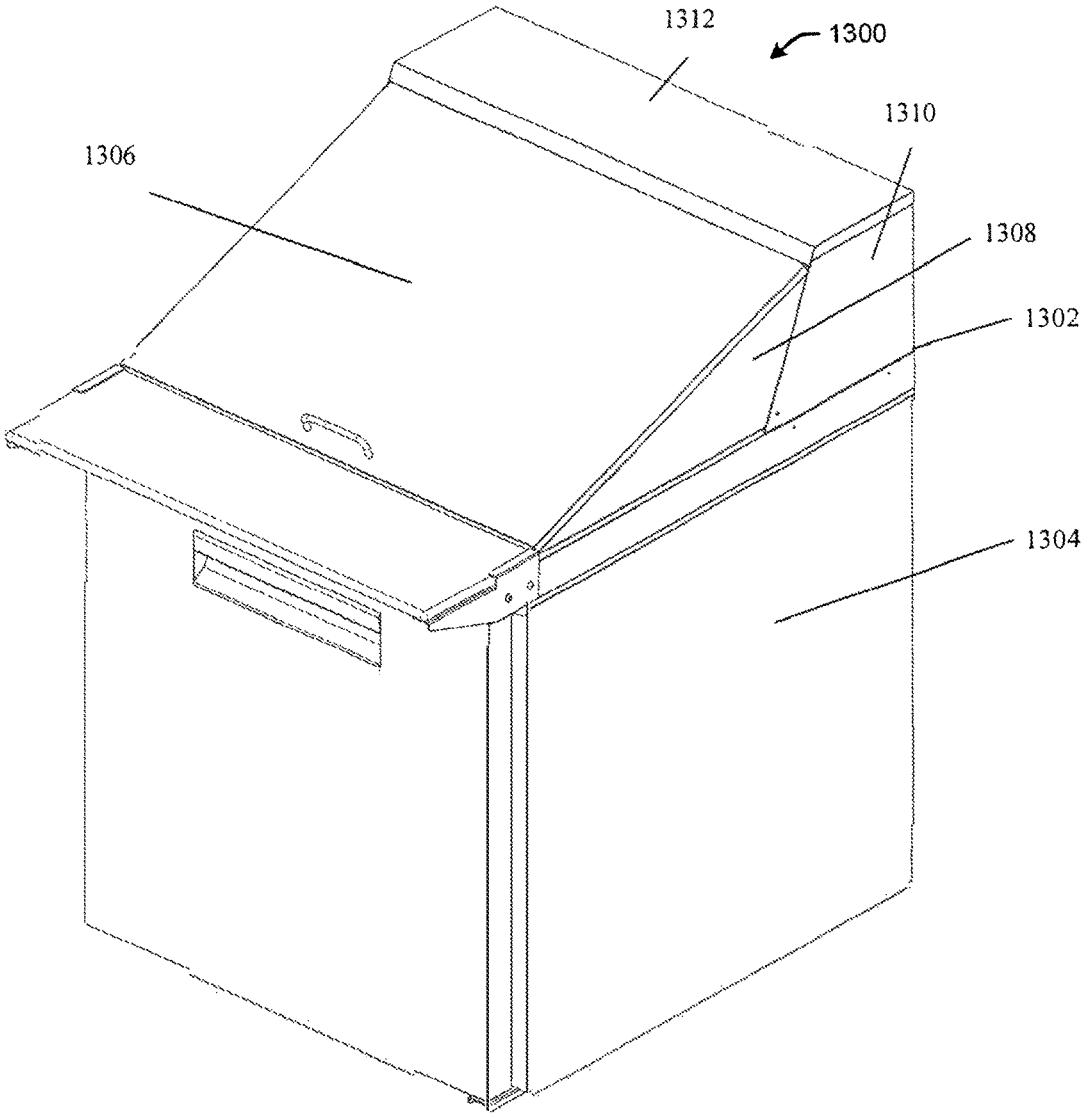
FIGS. 13-16 illustrate example collapsible hoods for a refrigeration unit according to certain embodiments of the disclosure.
Figure 14:
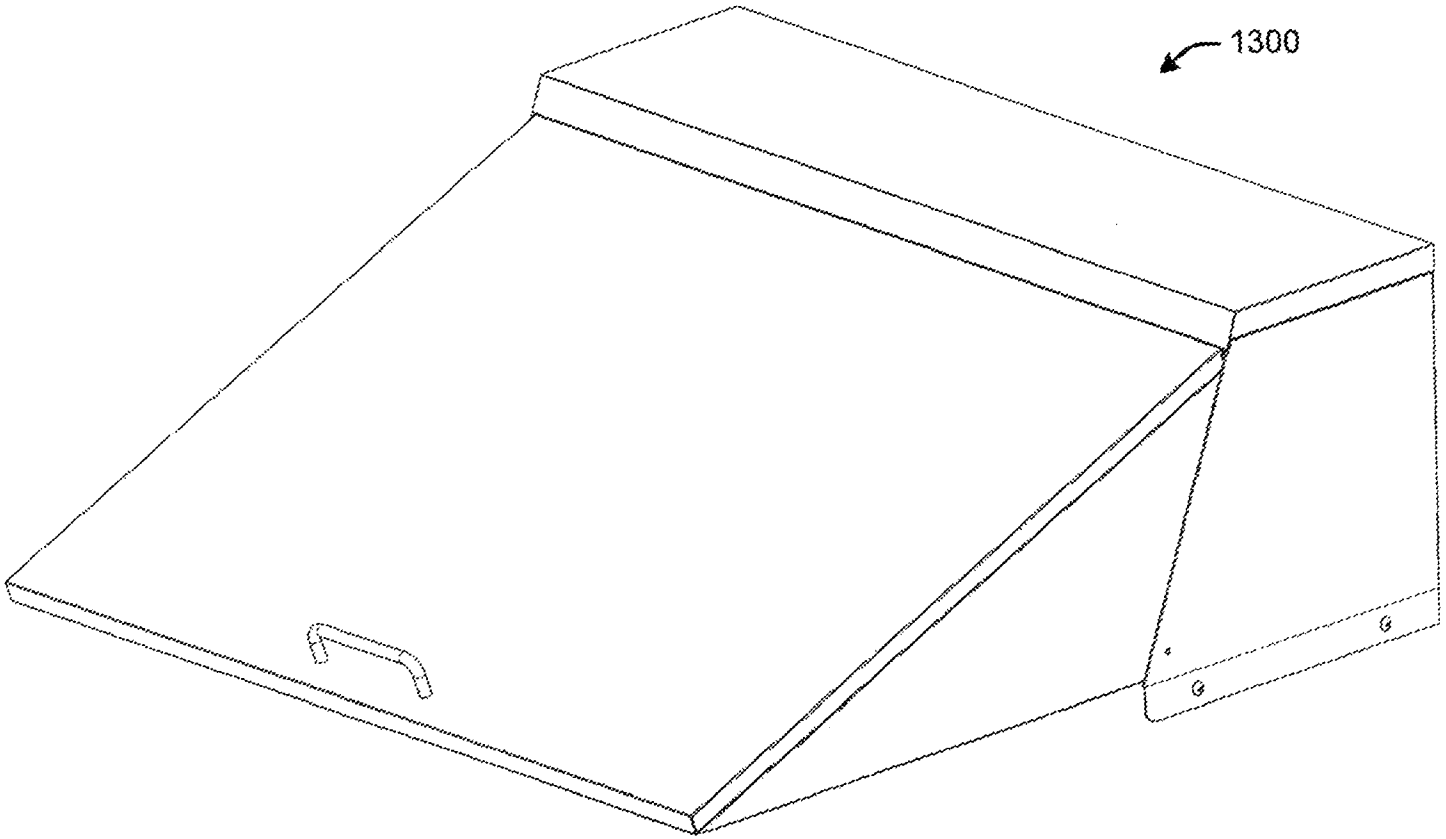
Figure 15:
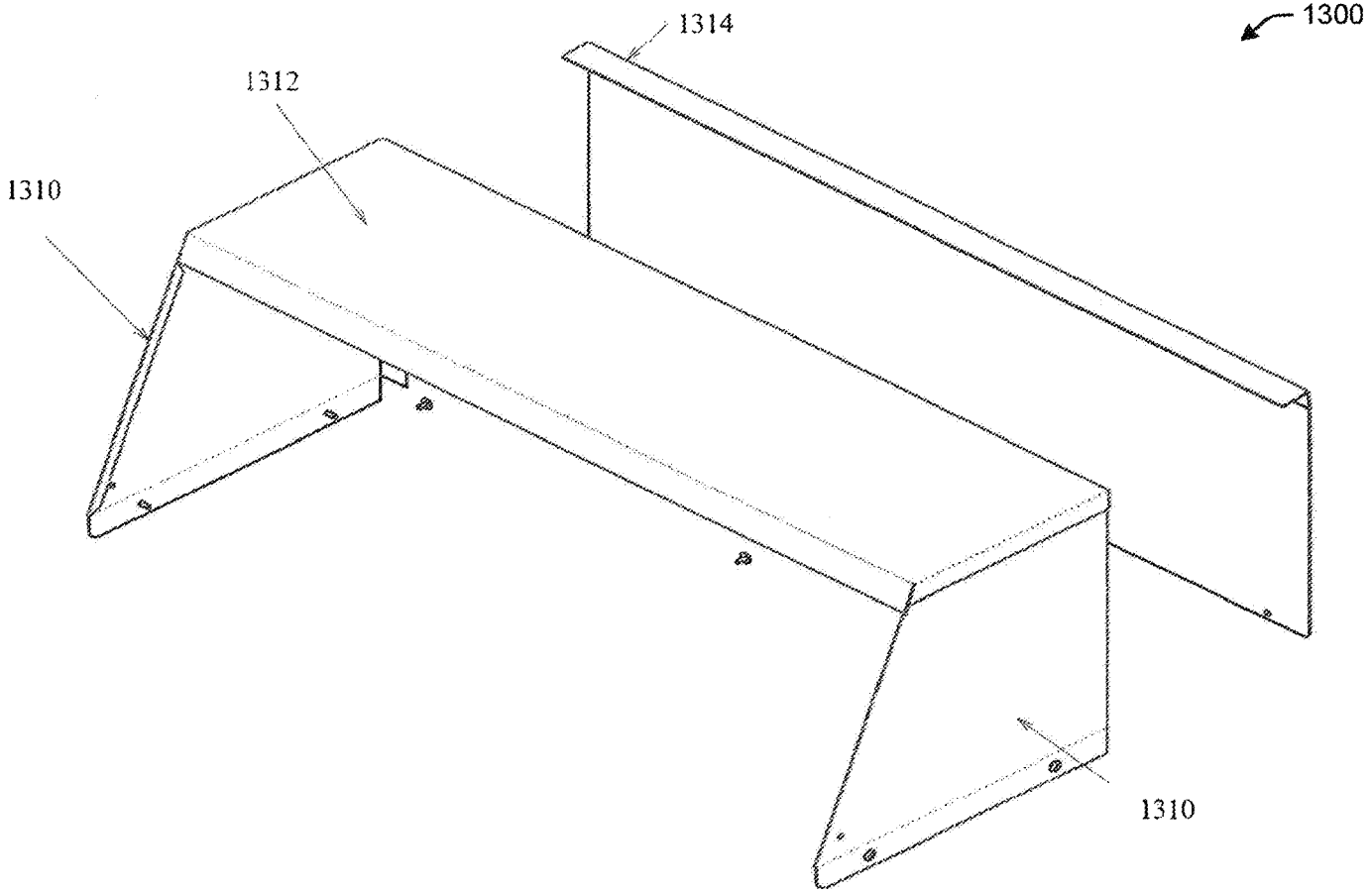
Figure 16:
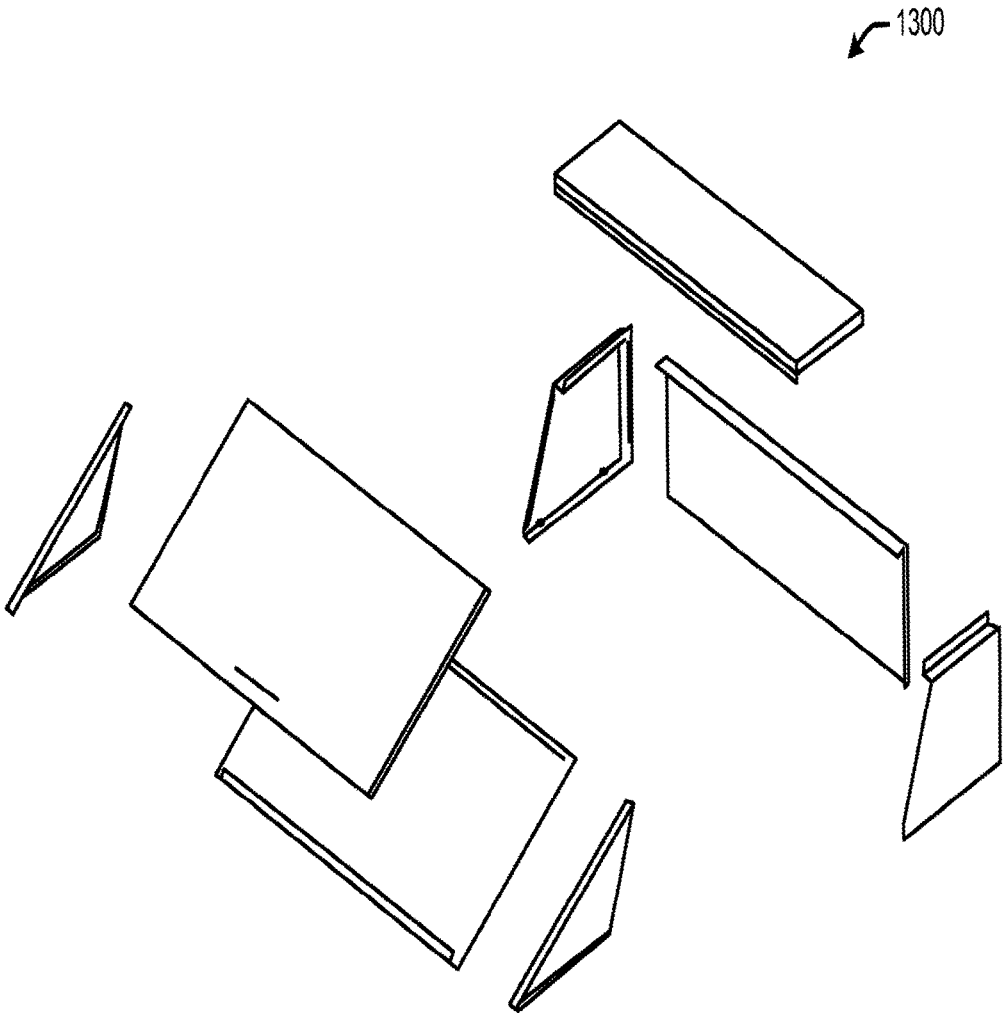

FIGS. 13-16 illustrate a modularized collapsible hood 1300 that can be mounted on an upper surface, such as 1302 in the perspective view of FIG. 13, of a refrigeration unit, such as 1304, according to certain embodiments of the disclosure. In the example of the perspective views shown in FIGS. 13-15, the hood 1300 can include a sloped door 1306 with at least one angled lateral side 1308, at least one lateral hood sidewall 1310, a horizontal hood upper wall 1312, and a rear wall 1314. The door 1306 can be operable to be manipulated or otherwise opened and closed with respect to an opening in the upper surface 1302 of the refrigeration unit 1304. An associated hinge mechanism or door retention device to permit the door 1306 to be manipulated can be housed within or mounted to the lateral hood sidewall 1310 and/or horizontal hood upper wall 1312. As shown in the exploded view of FIG. 16, the collapsible hood 1300 can include multiple components that can be configured in multiple parts that can be readily assembled as needed, some or all of which can be used for different sized models and/or types of the refrigeration unit 1304.

In the manner shown, a modularized collapsible hood can be readily assembled and installed with respect to a refrigeration unit. The modularized components can be used with different sized models and/or types of the refrigeration unit. In certain embodiments, the components of a modularized collapsible hood can be manufactured, shipped, and stored in a way to facilitate relatively smaller shipping containers. Some or all of the components can be commonized to provide relatively more options to an end user. Further, manufacturing, shipping, storing, and assembling the components of a modularized collapsible hood can be performed in a relatively safe manner to provide an end user alternatives for a refrigeration unit.

Figure 17:
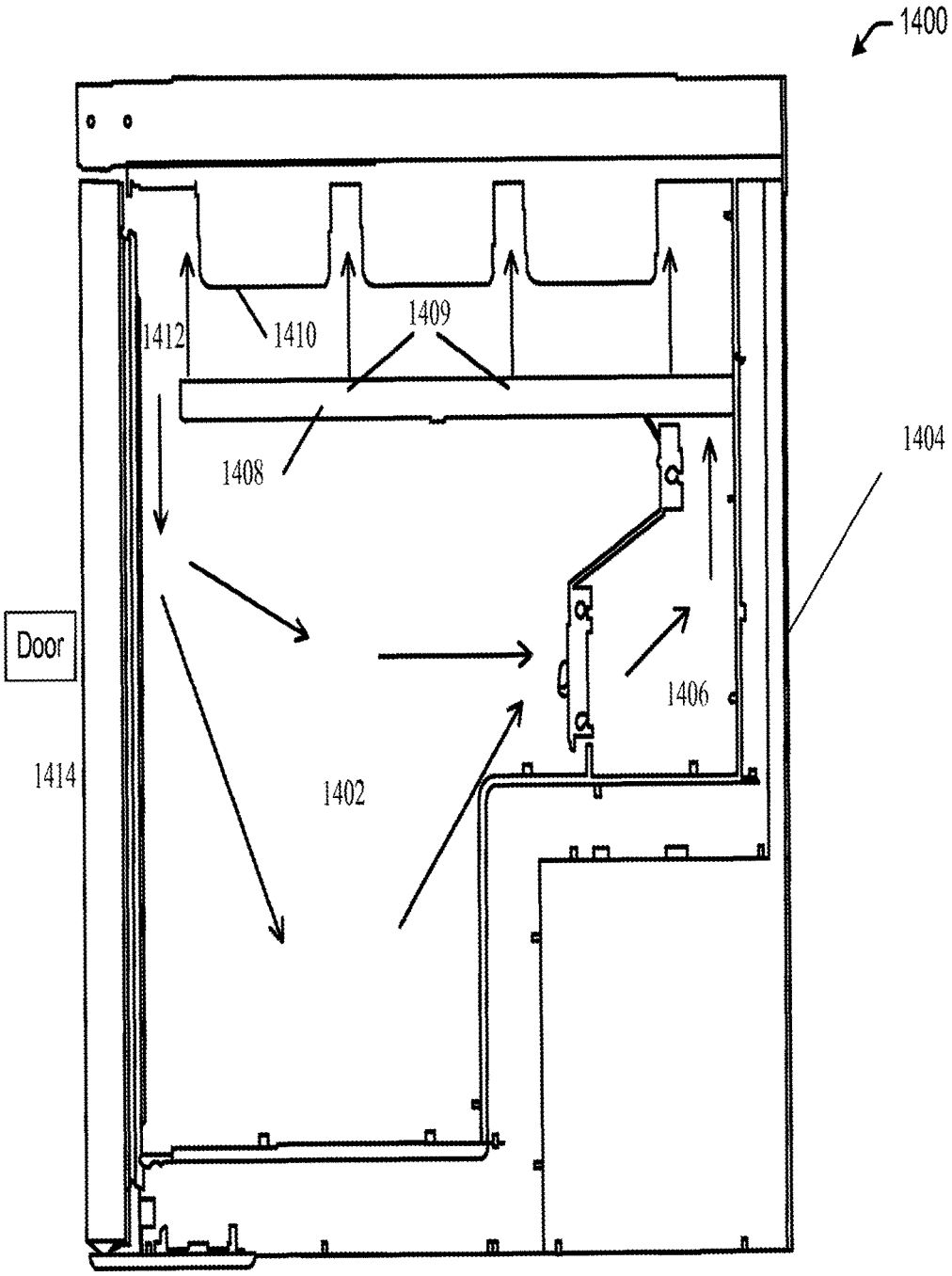
FIGS. 17 and 18 illustrate an internal circulation plenum for a refrigeration unit according to certain embodiments of the disclosure.
Figure 18:
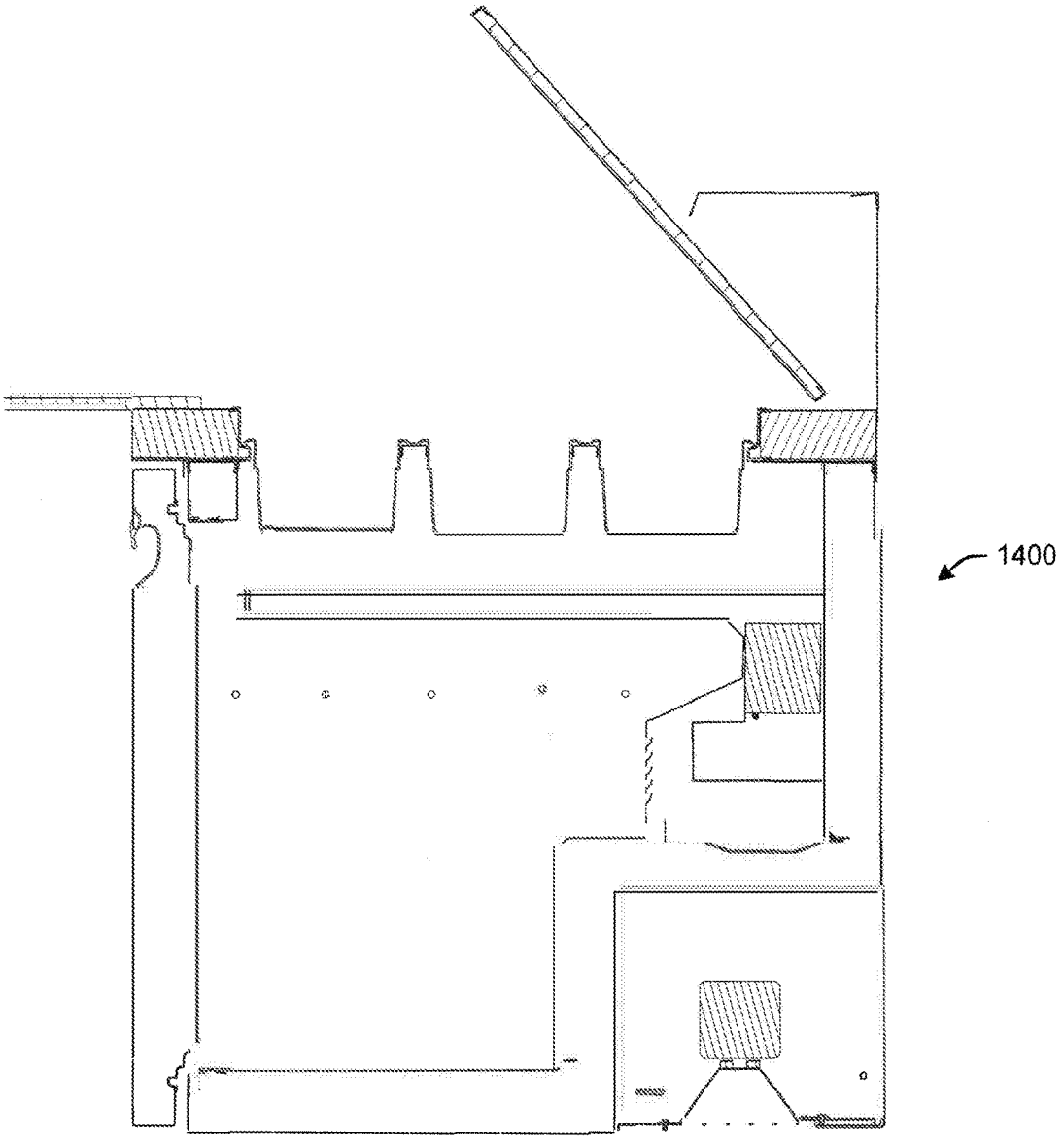

FIGS. 17 and 18 illustrate examples of an internal circulation plenum that can be configured within a refrigeration unit according to certain embodiments of the disclosure. As shown in the cutaway side view of FIG. 17, an internal circulation plenum 1400 can be operable to circulate air from a lower region 1402 or plenum of the refrigeration unit 1404 to an evaporator section 1406 or plenum, and then through a cooling table section 1408. The cooling table section 1408 or plenum, which can be relatively flat and/or elongated and can include one or more holes 1409 or openings through the table section to direct the air between respective plenums between one or more storage containers 1410 positioned in an upper portion of the refrigeration unit 1404. The cooling table section 1408 can be mounted above or adjacent to an evaporator component, wherein at least one opening in the cooling table section 1408 can receive air from or adjacent to the evaporator component. Thus, as the air is circulated from one end of the cooling table section to an opposing end of the cooling table section, air can be forced through the holes 1409 or openings upward towards the storage containers 1410. Air is then recirculated from the upper portion of the refrigeration unit 1404 downward from the front portion 1412 or plenum adjacent to the door 1414 of the refrigeration unit 1404 towards the rear portion 1402 or plenum beneath the cooling table section 1408 or plenum.

Figure 19:
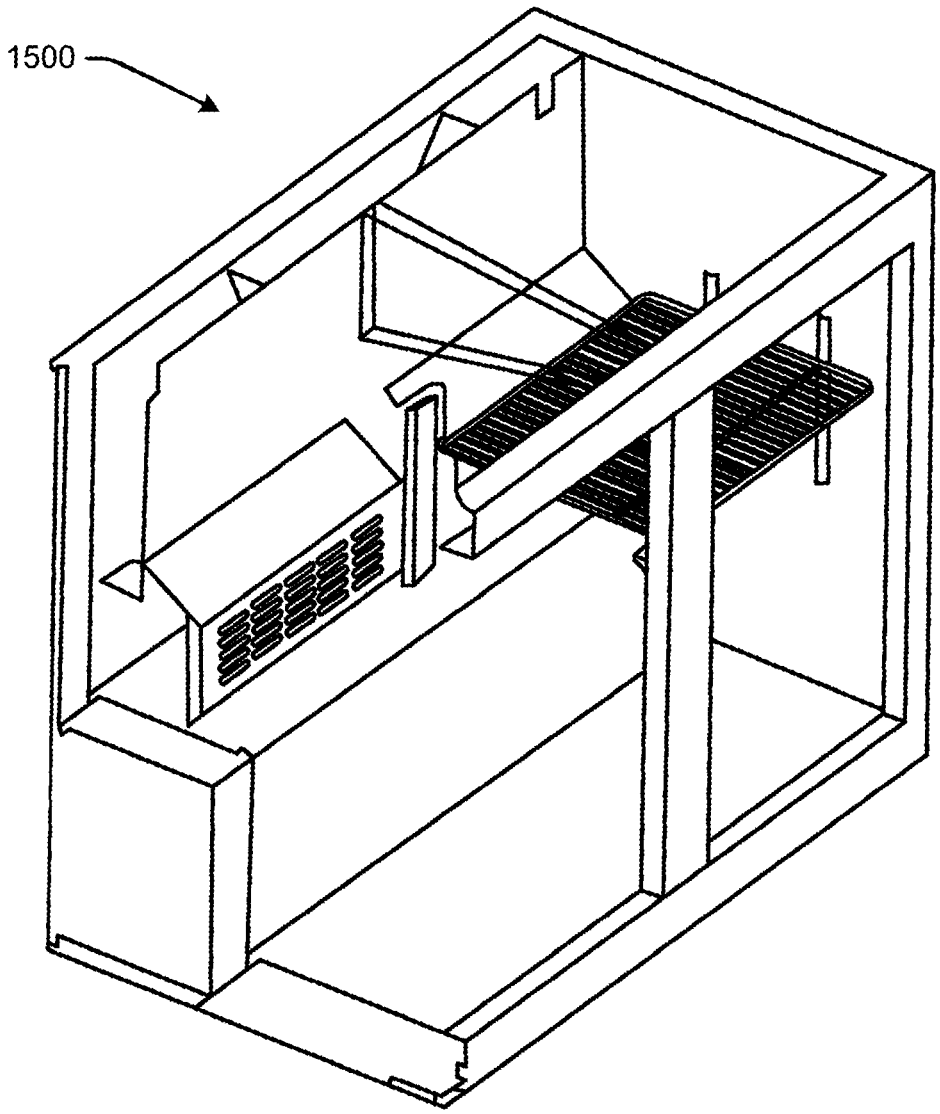
FIGS. 19 and 20 illustrate an internal circulation bracket for a refrigeration unit according to certain embodiments of the disclosure.
Figure 20:
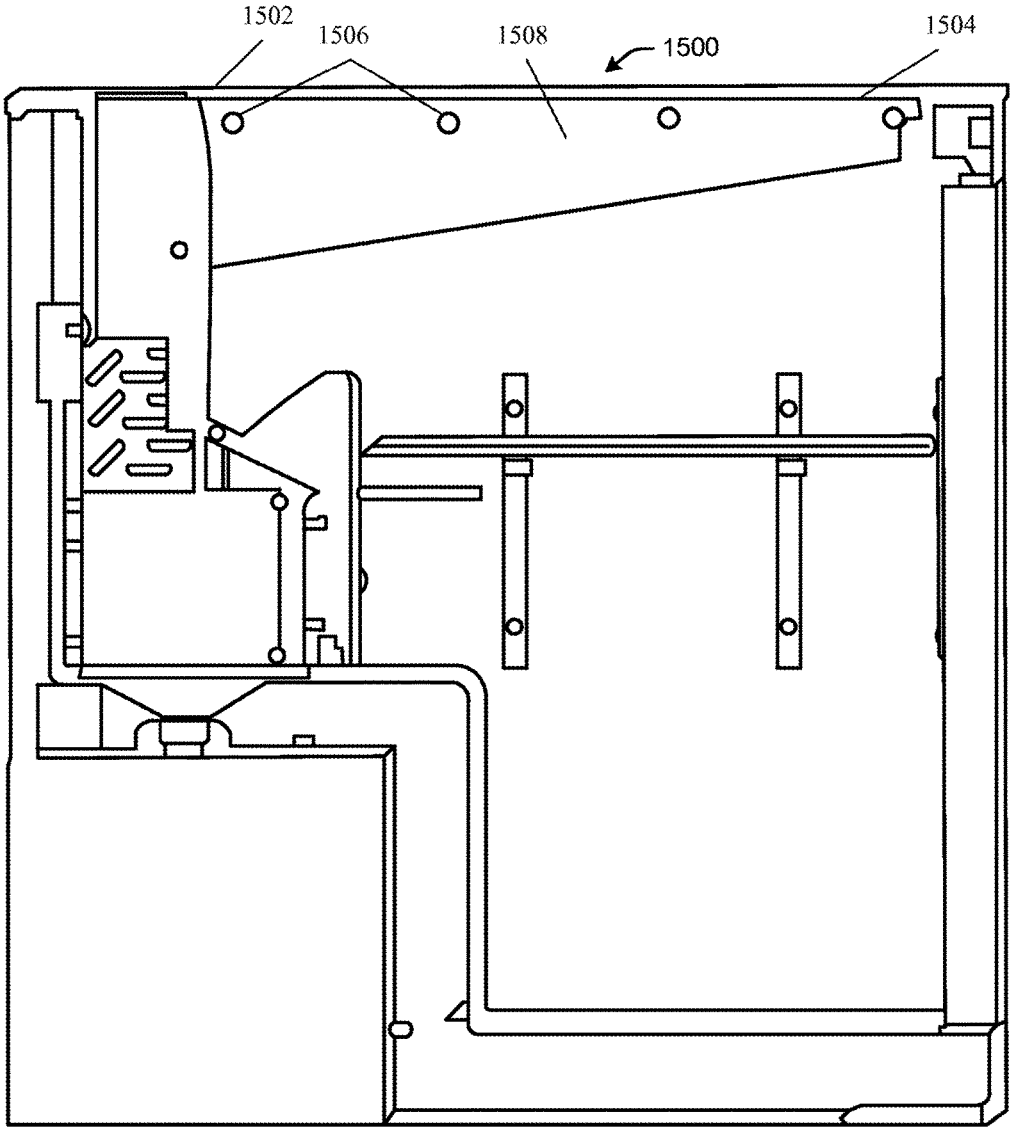
Figure 21:
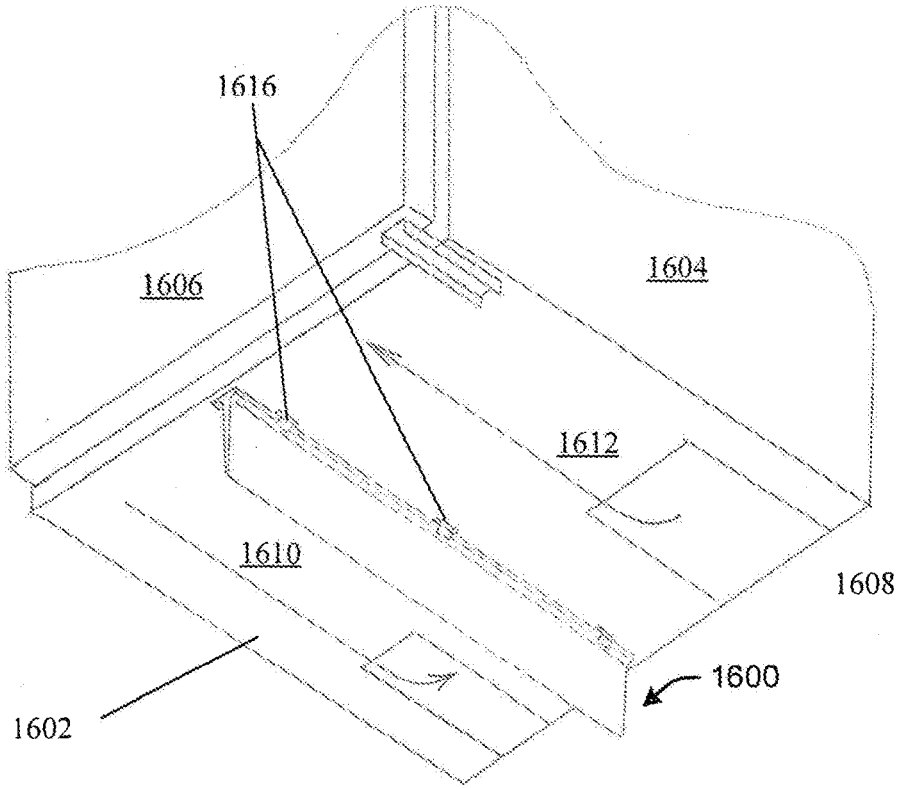
FIGS. 21-23 illustrate an example external rib for a refrigeration unit according to certain embodiments of the disclosure.

FIGS. 19 and 20 illustrate examples of an internal circulation bracket that can be configured within a refrigeration unit according to certain embodiments of the disclosure. An internal circulation bracket 1500, also referred to as an internal channel restrictor, shown in the perspective view of FIG. 19 and the cutaway side view of FIG. 20, can be a generally hollow bracket operable to circulate relatively cooler air from one end 1502 to an opposing end 1504 of the bracket 1500. One or more circulation holes 1506 or openings can be machined in one or more lateral sides 1508 of the bracket 1500 to permit cooling air to pass through the lateral sides 1508 of the bracket 1500. The bracket 1500 can be manipulated or otherwise moved from one location to another location within a refrigeration unit to create air circulation channels between one or more storage containers mounted or otherwise supported in an upper portion of the refrigeration unit.

Figure 22:
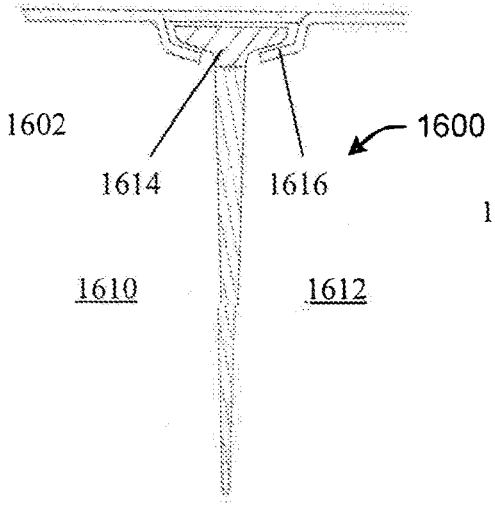
Figure 23:
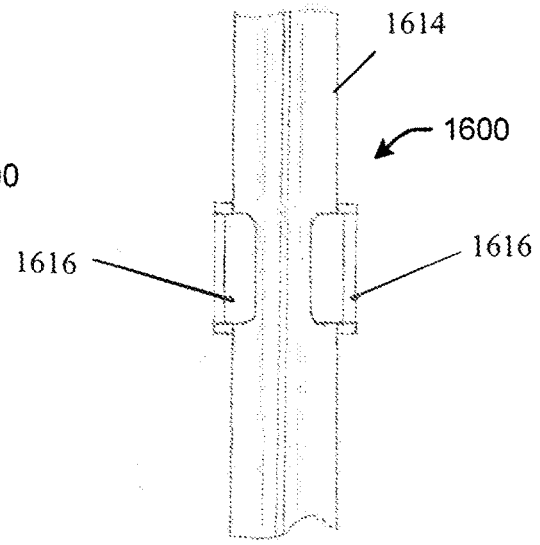
Figure 24A:
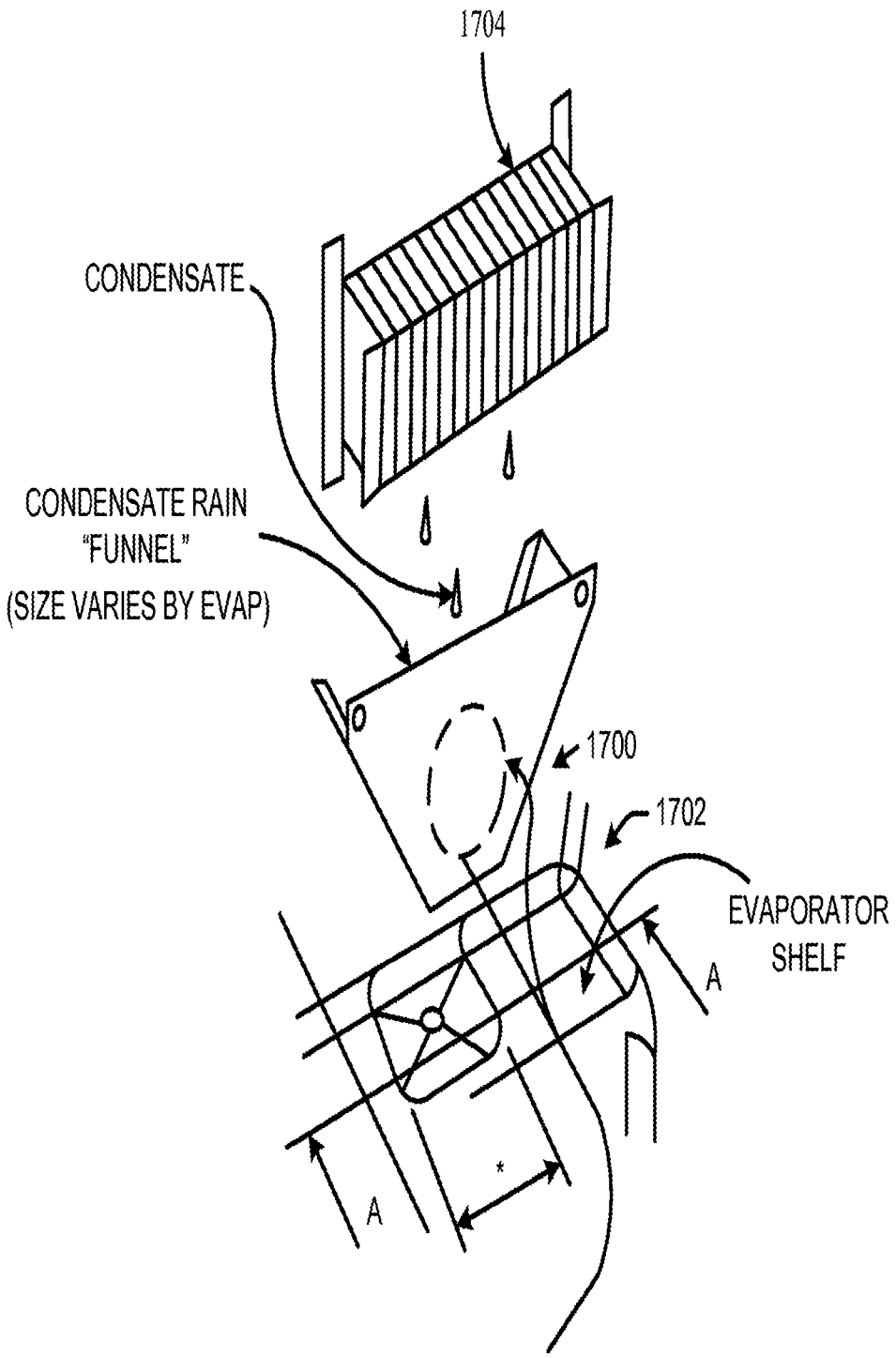
FIGS. 24A, 24B, 24C, 24D, 24E, and 25 illustrate an example evaporator shroud, condensate drain, and evaporator component for a refrigeration unit according to certain embodiments of the disclosure.
Figure 24B:
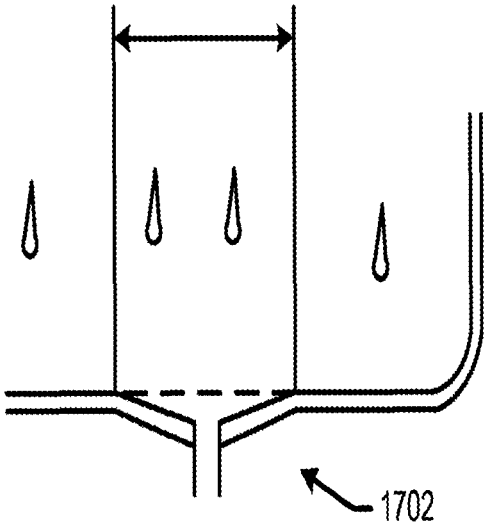
Figure 24C:
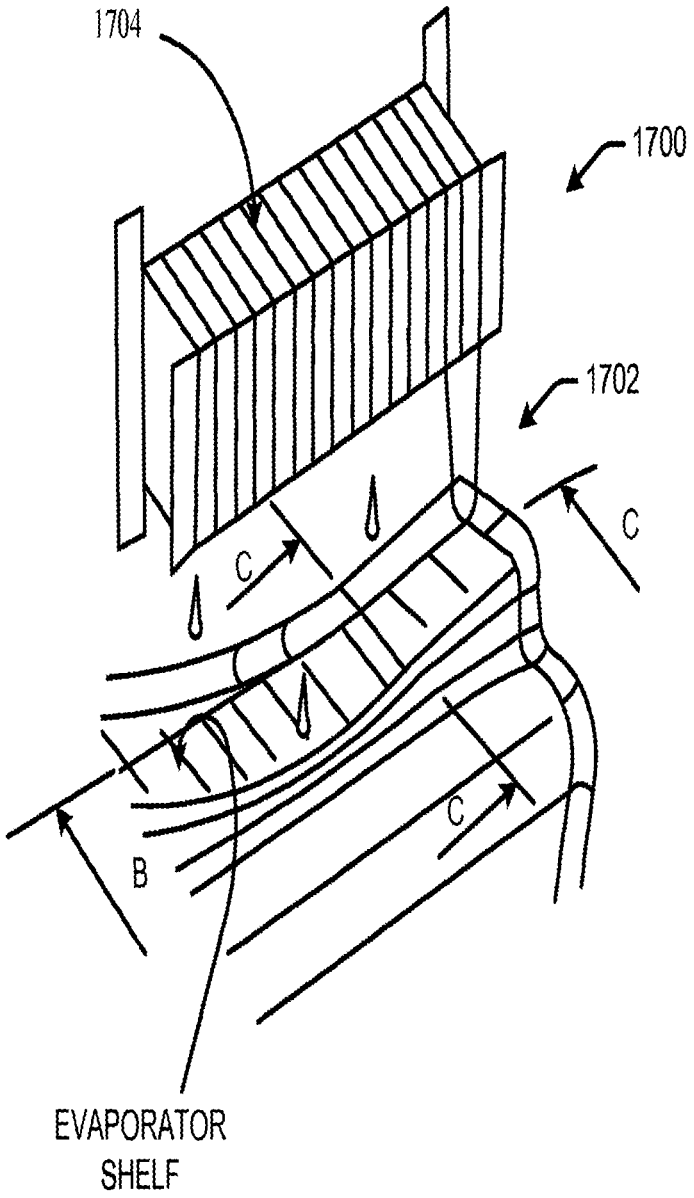
Figure 24D:
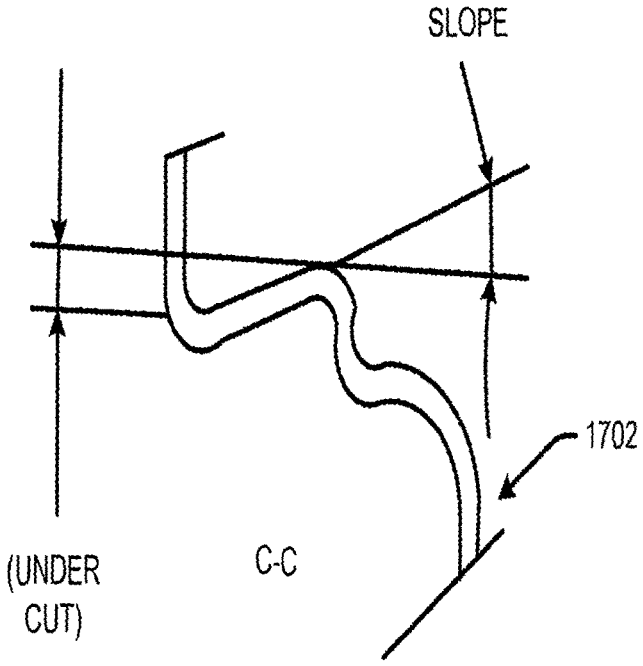
Figure 24E:
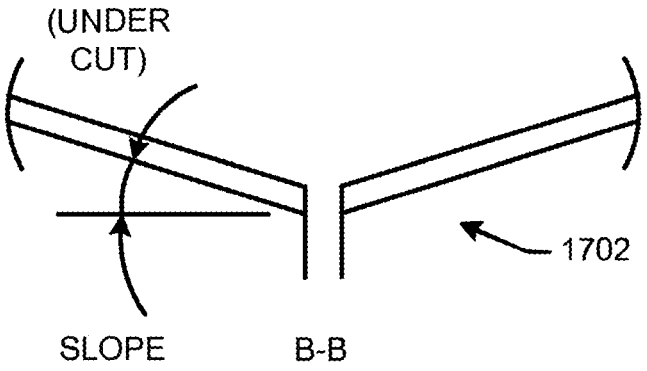

In the manner described above, an internal circulation bracket for a refrigerator unit can provide a novel way of distributing air among any storage containers and within the unit. In some instances, an internal circulation bracket can be positioned such that cooling air enters one end and the opposite end is blocked. One or more internal circulation brackets can be spaced such that any supporting structures, such as a cooling table operable to hold the storage containers or other food service devices, can provide cooling air within one or more channels to create an air duct. One or more vent holes can direct cooling air to the channels to direct air between storage containers or other food service devices to facilitate relatively efficient cooling and even temperature distribution. The channels can be configured to allow for many combinations of different sized storage containers or other food service devices to be used within the refrigeration unit. In this manner, a relatively effective and even distribution of cooling air can be provided to the storage containers or other food service devices and the interior space of the refrigeration unit In FIGS. 21-23, an example of a rib according to an embodiment of the disclosure is shown. A rib 1600 shown in the lower perspective view of FIG. 21, the cutaway end view of FIG. 22 and the lower view of FIG. 23 can be operable to prevent or minimize short circuiting, and can be mounted to a lower external surface 1602 of a refrigeration unit 1604. The rib 1600 can extend from a front portion 1606 of the refrigeration unit 1604 to a rear portion 1608 of the refrigeration unit, and extend substantially perpendicularly away from the external surface 1602 of the refrigeration unit 1604. The air space and/or flow 1610 on one side of the rib 1600 can generally be maintained separately from the air space and/or flow 1612 on the other side of the rib 1600. The rib 1600 can include a T-shaped base 1614, which can be mounted to one or more mounting devices 1616 supported on the external surface 1602 of the refrigeration unit 1604. In some embodiments, a positive stop or other device can be mounted to the rib 1600, the base 1614, and/or the associated refrigeration unit 1604 to limit or otherwise prevent further movement of the rib 1600 with respect to the base 1614 and/or the refrigeration unit 1604. In some embodiments, the relative stiffness or hardness of the rib 1600 may vary in different areas or regions of the rib. For example, the relative stiffness or hardness of the rib 1600 may be higher in the region adjacent to the base 1614 as shown in FIG. 22 by coextruding a single profile using two different materials. In the embodiment shown in FIGS. 21-23, the rib 1600 can be slidably mounted into one or more mounting devices 1616.

In the manner described above, a refrigeration unit can include a rib or curtain mounted on the underside of the unit, such as in an undercounter installation, to allow the unit to be installed flush on some or all sides for maximum floor usage and to minimize or otherwise prevent short cycling of air through an associated condenser. In some instances, the rib or curtain can be installed relatively easily by a user or installation personnel. A positive stop at the front or rear of the rib or curtain may be used to let the user or installation personnel know that the rib or curtain is fully seated. In this manner, relatively cool ambient air can be guided from the front of the refrigeration unit into the associated condenser, and short cycling can be minimized or otherwise prevented.

Figure 25:
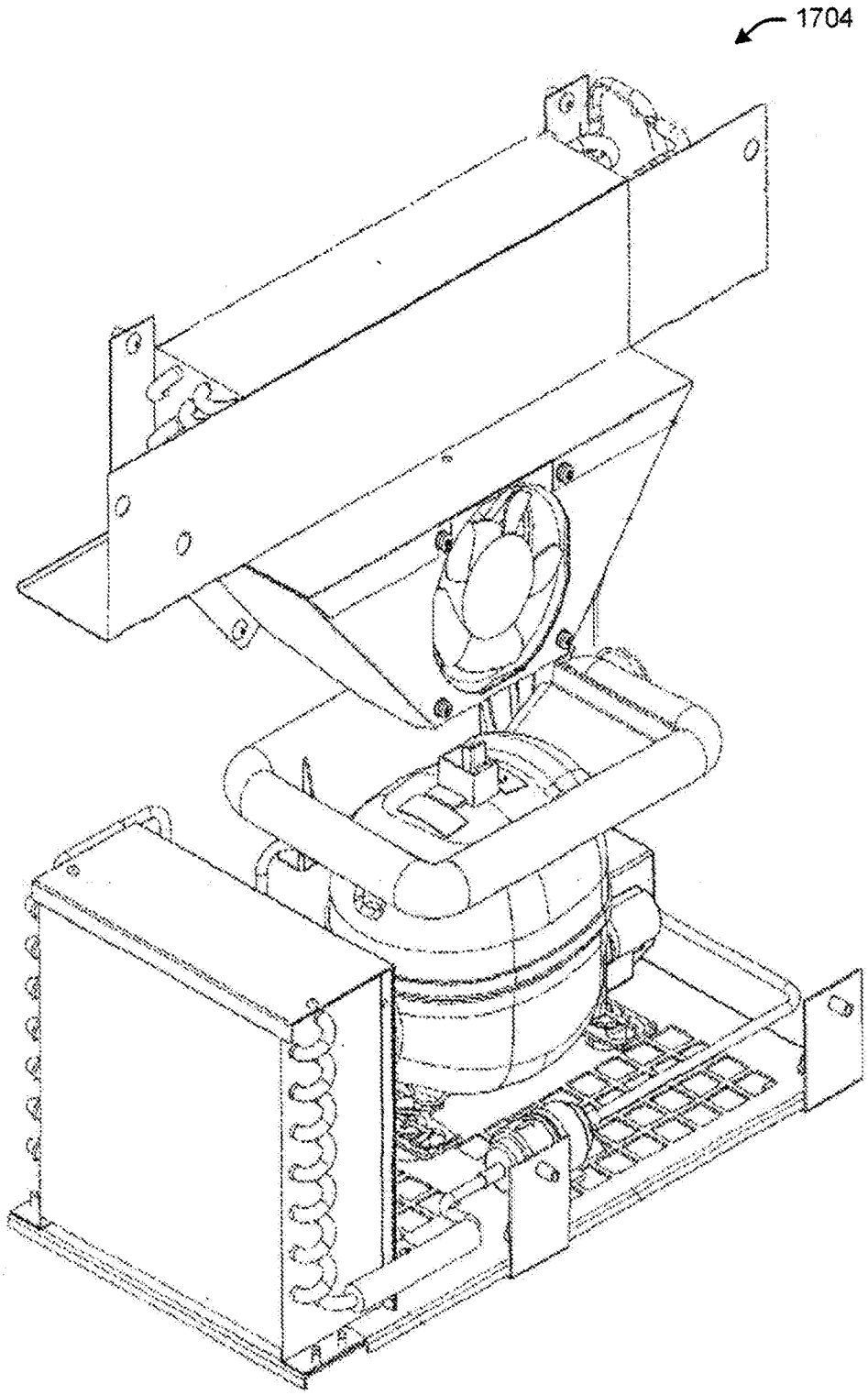
Figure 26A:
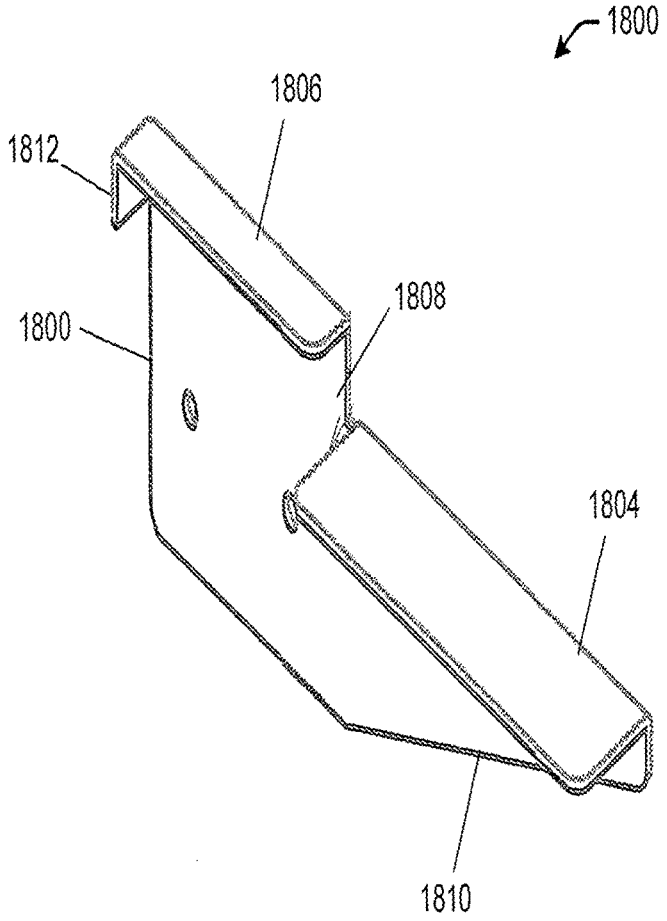
FIGS. 26A, 26B, 26C, 26D, 26E, 27A, 27B, 27C, 27D, and 27E illustrate example cutting board support brackets for a refrigeration unit according to certain embodiments of the disclosure.
Figure 26B:
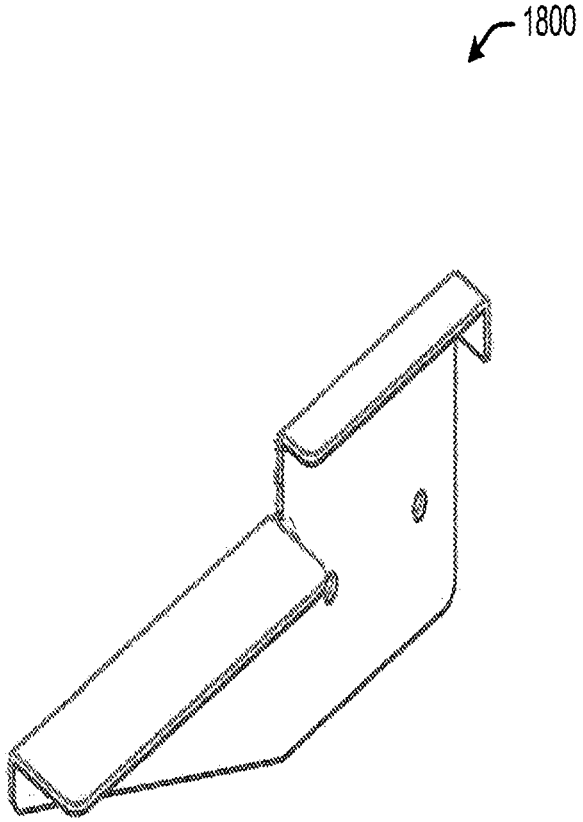
Figure 26C:
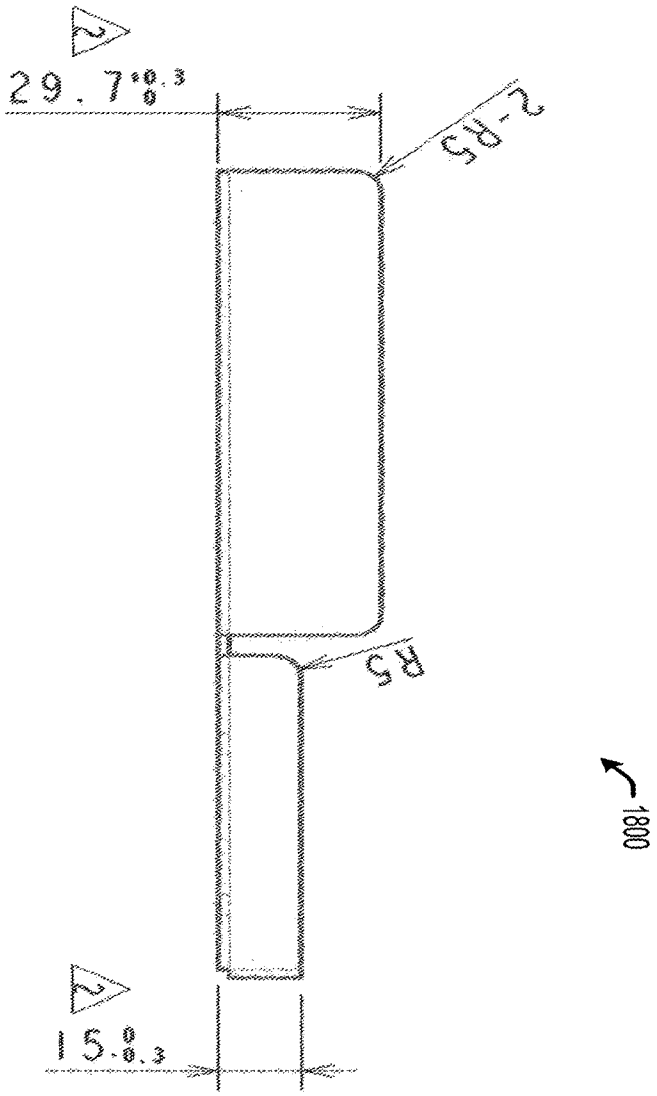
Figure 26D:
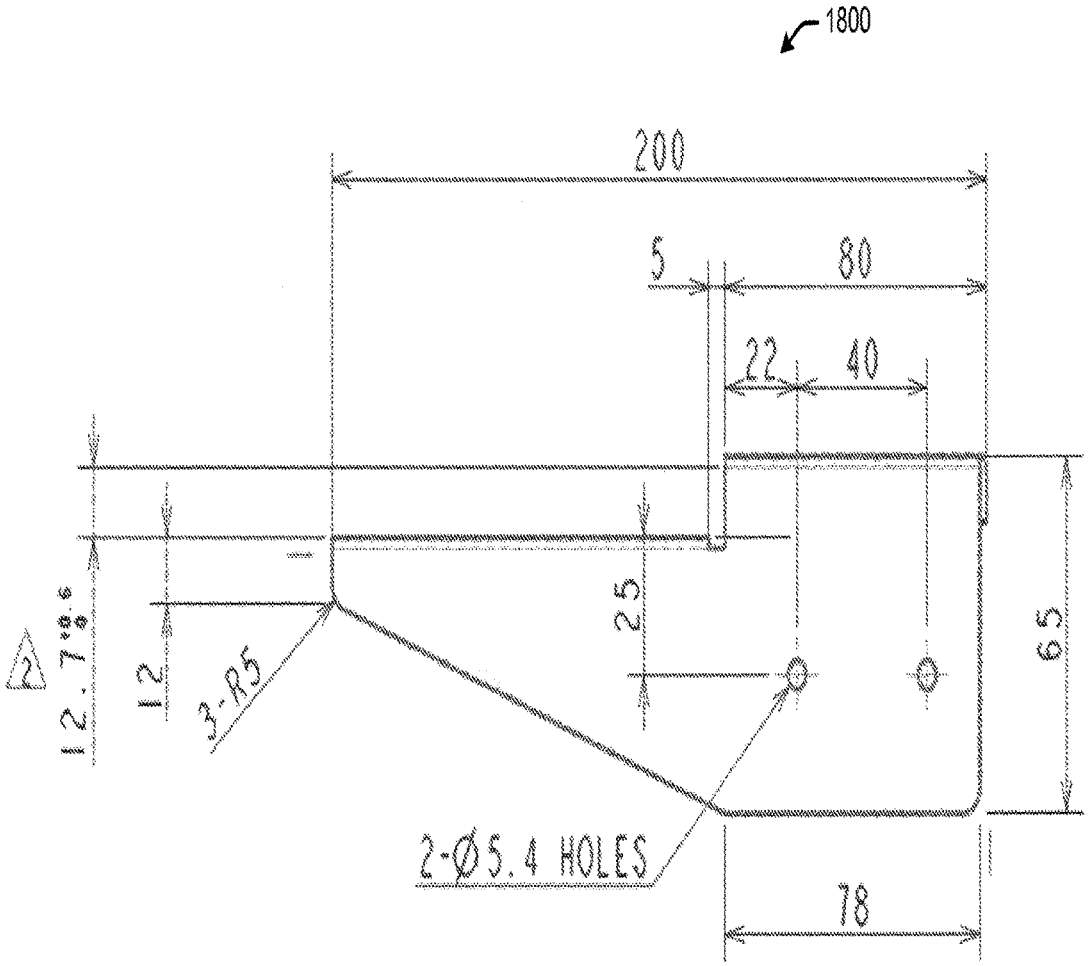
Figure 26E:
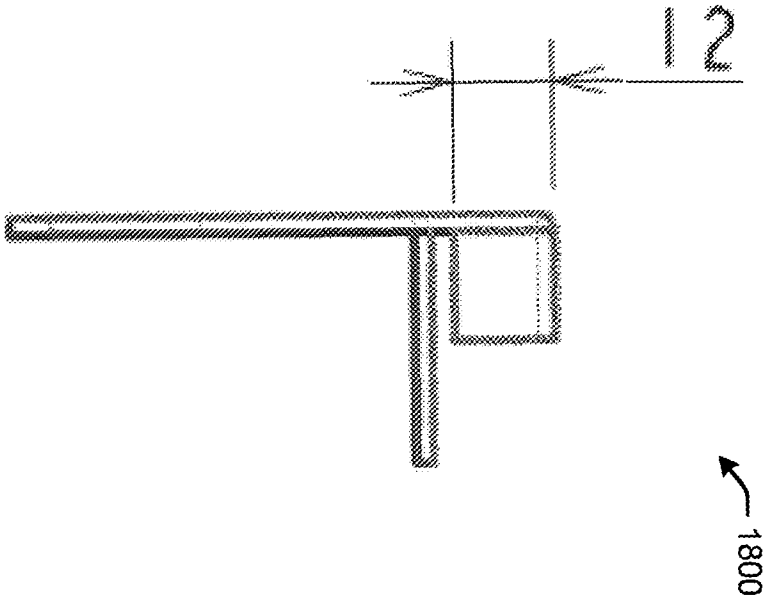

As shown in the perspective views of FIGS. 24A-24E and 25, an evaporator shroud 1700, a condensate drain 1702, and an evaporator component 1704 for a refrigeration unit can be provided according to certain embodiments of the disclosure. The evaporator shroud 1700 can be operable to enclose at least a portion of an evaporator component 1704 associated with a refrigeration unit. The evaporator shroud 1700 can be shaped to generally conform with the shape of the evaporator component 1704 and to generally direct some or all of any condensate from the evaporator component 1704 towards an associated condensate drain 1702. The condensate drain 1702 can be a pan-shaped component, separate from the evaporator shroud and the evaporator component, which can receive condensate directed towards it from the evaporator shroud 1700 and further direct some or all of the condensate towards an opening or hole in the condensate drain 1702. The evaporator shroud 1700 and the condensate drain 1702 can be manufactured from ABS and/or metal, or similar durable material, and can be used on multiple models and/or types of a refrigeration unit. FIG. 25 illustrates the evaporator component 1704 separated from the evaporator shroud 1700 and the condensate drain 1702.

In the manner described above, a refrigeration unit can incorporate a combined evaporator shroud and condensate drain. In one embodiment, an evaporator shroud and condensate drain can be functionally combined. A shroud can be sloped at each side and slightly forward of an evaporator coil to help evenly distribute air across the front face of the coil and to allow room for condensation to shed off the coil to the drain. An upper shroud can mate directly to a lower shroud to channel the air through the coil, block air from recirculation, and also help channel condensate water to the drain.

As shown in FIGS. 26A-26E and 27A-27E, examples of a cutting board support bracket 1800, 1900 can be mounted to an upper portion of a refrigeration unit according to certain embodiments of the disclosure. In the perspective views of FIGS. 26A and 26B, overhead view of FIG. 26C, side view of FIG. 26D, and end view of FIG. 26E, a cutting board support bracket 1800 can be operable to support the cutting board generally horizontal and parallel with respect to an upper portion, such as an upper surface, of the refrigeration unit. The bracket 1800 shown can include a generally vertical mounting surface 1802, a lower cutting board support surface 1804, and an upper cutting board support surface 1806. The mounting surface 1802 can be machined to accommodate one or more holes or openings to mount the bracket 1800 to a lateral side of a refrigeration unit. Further, a rear portion 1808 of the mounting surface 1802 can be generally larger than the front portion 1810 of the mounting surface 1802, wherein the rear portion 1808 of the mounting surface 1802 is relatively closer to the refrigeration unit than the front portion 1810 of the mounting surface 1802. A stop 1812 can be mounted at a rear portion of the upper cutting board support surface 1806 to limit or otherwise prevent the cutting board from being positioned further than the end of the cutting board support bracket 1800. When a pair of mounting brackets 1800 are mounted on opposing lateral sides of a refrigeration unit, a cutting board can be horizontally positioned between the mounting brackets 1800, such that each of the corresponding lower cutting board support surfaces 1804 contact the lower surface of the cutting board, and each of the corresponding upper cutting board support surfaces 1806 contact the upper surface of the cutting board. The cutting board can be positioned in a relatively horizontal position with respect to the upper surface of the refrigeration unit.

Figure 27A:
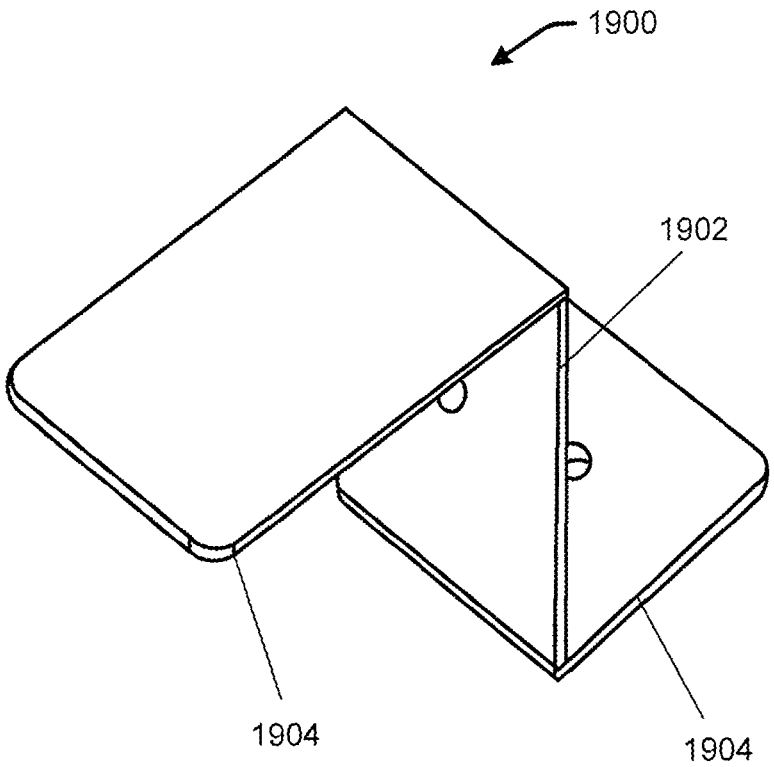
Figure 27B:
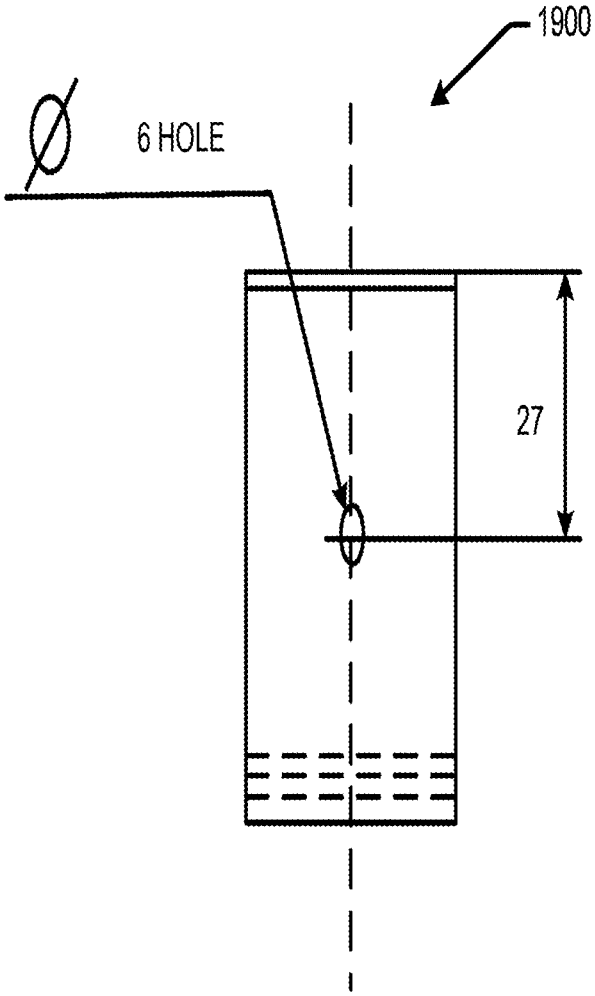
Figure 27C:
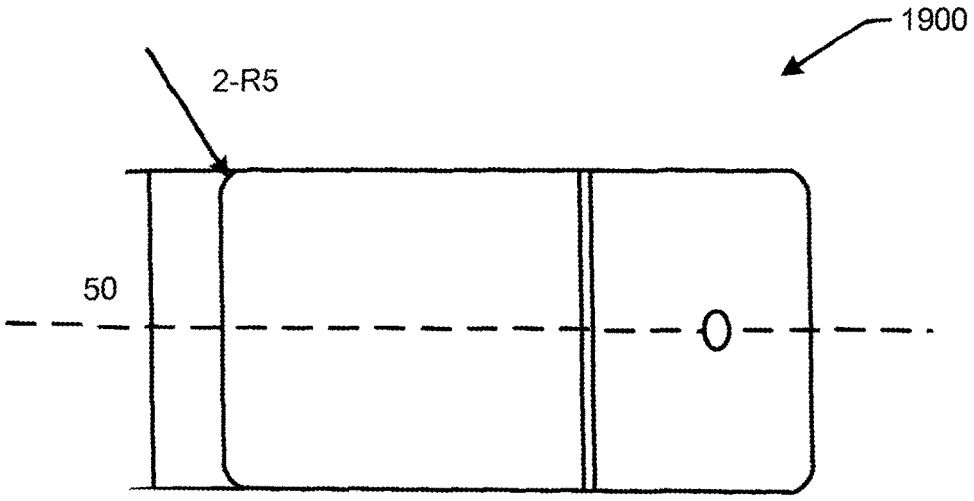
Figure 27D:
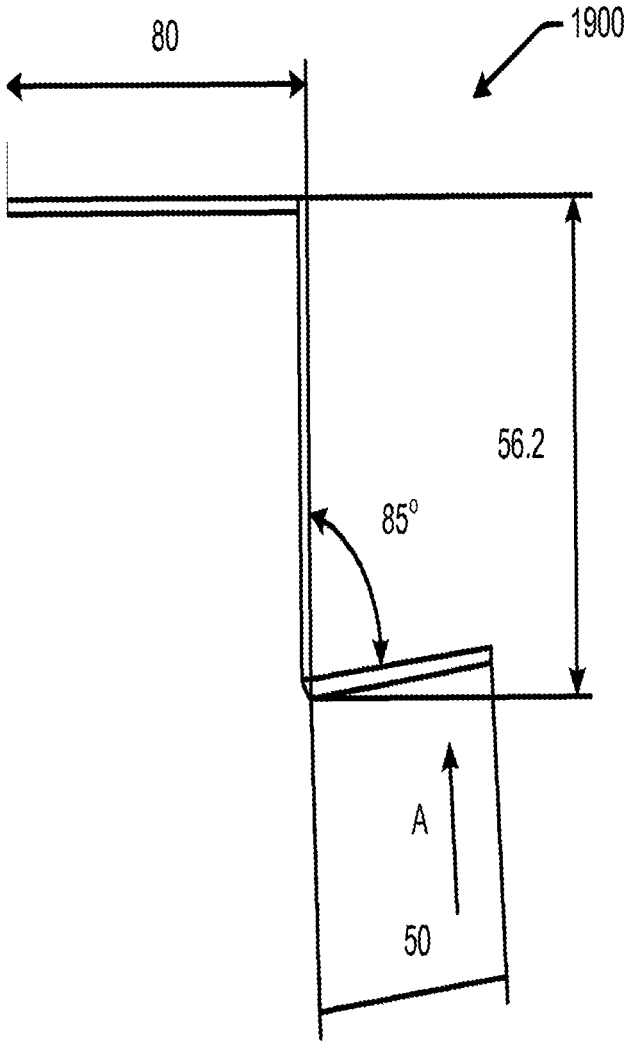
Figure 27E:
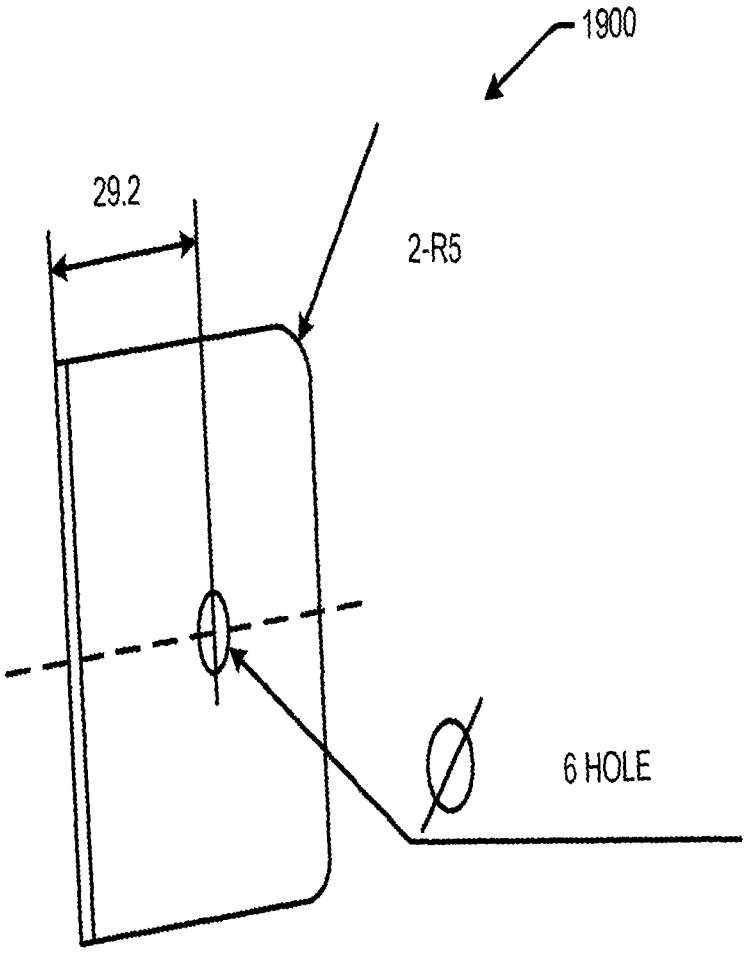

In the perspective view of FIG. 27A and side views of FIGS. 27B-27E, another example of a cutting board support bracket 1900 is shown. The bracket 1900 shown can include a generally vertical mounting surface 1902 and an upper cutting board support surface 1904. The mounting surface 1902 can be machined to accommodate one or more holes or openings to mount the bracket 1900 to a lateral side of a refrigeration unit. When a pair of mounting brackets 1900 are mounted on opposing lateral sides of a refrigeration unit, a cutting board can be horizontally positioned between the mounting brackets 1900, such that each of the corresponding upper cutting board support surfaces 1904 contact the upper surface of the cutting board. The cutting board can be positioned in a relatively horizontal position with respect to the upper surface of the refrigeration unit.

In this manner, a refrigeration unit can include a bracket to support a cutting board on top of the unit without requiring the need for a relatively larger top surface. The geometry of the bracket can be used to support a cutting board and hold it in place relative to the refrigeration unit. The geometry can minimize or otherwise prevent the cutting board from being lifted up once it is installed. In certain instances, the cutting board has to be slid frontward with respect to the bracket to be secured or to be removed. In this manner, increased user safety and ease of use can result.

While the above description contains many specifics, these specifics should not be construed as limitations on the scope of the disclosure, but merely as exemplifications of the disclosed embodiments. Those skilled in the art will envision many other possible variations that are within the scope of the disclosure.

That which is claimed is:

1. A refrigeration unit comprising:

a front portion;

a rear portion distal from the front portion;

a cooling table section extending horizontally from the rear portion towards the front portion and past a plurality of storage containers received within the refrigeration unit;

an upper portion positioned between the front portion and the rear portion, positioned above the cooling table section, and defining a circumferential opening configured to receive the plurality of storage containers;

a lower region distal from and below the upper portion and positioned below the cooling table section, the lower region configured for food storage;

a door positioned proximate to the front portion and configured to give a user selective access to both the upper portion and the lower region, the lower region in communication with the upper portion by a plenum defined between a front edge of the cooling table section and the door of the refrigeration unit when the door is closed; and an evaporator section proximate to the rear portion and configured to deliver air to the cooling table section;

wherein the cooling table section comprises an upper cooling table component and a lower cooling table component in parallel orientation to the upper cooling table component, the upper cooling table component and the lower cooling table component defining a plenum; the upper cooling table component defining a plurality of holes allowing passage of air from the plenum of the cooling table section to the upper portion of the refrigeration unit.

2. The refrigeration unit of claim 1, wherein the upper cooling table component is removable from the lower cooling table component and from the refrigeration unit to expose an internal surface of the plenum of the cooling table section.

3. The refrigeration unit of claim 2, wherein the lower cooling table component is removable from the refrigeration unit.

4. The refrigeration unit of claim 1, wherein the cooling table section is positioned above the evaporator portion.

5. The refrigeration unit of claim 1, wherein the evaporator section is configured to circulate air exclusively to the cooling table section and the lower cooling table component is substantially impervious to air flow to the lower region of the refrigeration unit.

6. The refrigeration unit of claim 1, further comprising a hood, the hood covering the circumferential opening when a door of the hood is closed.

7. The refrigeration unit of claim 1, wherein each of the plurality of holes is spaced evenly apart in the upper table cooling component and is spaced vertically an equal distance from the circumferential opening.

8. The refrigeration unit of claim 1, further comprising the plurality of pans, the plurality of pans positioned in the circumferential opening.

9. A refrigeration unit comprising:

a front portion;

a rear portion distal from the front portion;

a cooling table section extending from the rear portion towards the front portion;

an upper portion positioned between the front portion and the rear portion, positioned above the cooling table section, and defining a circumferential opening configured to receive a storage container;

a lower region distal from and below the upper portion and at least partially separated from the upper portion by the cooling table section defining a plenum defining holes allowing passage of air from the plenum of the cooling table section to the upper portion of the refrigeration unit, the plenum of the cooling table section comprising upper and lower walls extending to the forwardmost portion of the cooling table section proximate to the front portion, the lower region configured for food storage; and an evaporator section proximate to the rear portion and configured to circulate air to the cooling table section.

10. The refrigeration unit of claim 9, wherein the circumferential opening is defined in a horizontal surface of the refrigeration unit, the horizontal surface extending from the rear portion of the refrigeration unit to the front portion of the refrigeration unit.

11. The refrigeration unit of claim 9, wherein the circumferential opening is trimmed by a thermal breaker.

12. The refrigeration unit of claim 9, further comprising the plurality of pans, the plurality of pans positioned in the circumferential opening.

13. The refrigeration unit of claim 9, further comprising a door hingedly mounted to the front portion and configured to give a user selective access to the upper portion and the lower region, the lower region in communication with the upper portion by a plenum defined between a front edge of the cooling table section and the door of the refrigeration unit when the door is closed.

14. The refrigeration unit of claim 9, wherein the cooling table section extends horizontally from the rear portion towards the front portion past the storage container when the storage container is received within the forwardmost portion of the circumferential opening of the refrigeration unit.

15. The refrigeration unit of claim 9, wherein the cooling table section comprises an upper cooling table component and a lower cooling table component in parallel orientation to the upper cooling table component, the upper cooling table component and the lower cooling table component defining the plenum; the upper cooling table component defining the holes of the plenum of the cooling table section, air from the evaporator section able to circulate only into the plenum of the cooling table section.

16. A method of using a refrigeration unit, the method comprising:

powering on the refrigeration unit, the refrigeration unit comprising:

a front portion;

a rear portion distal from the front portion;

a cooling table section extending horizontally from the rear portion towards the front portion, the cooling table section comprising an upper cooling table component and a lower cooling table component in parallel orientation to the upper cooling table component, the upper cooling table component and the lower cooling table component defining a plenum comprising walls formed by the upper cooling table component and the lower cooling table component; the upper cooling table component defining holes allowing passage of air from the plenum of the cooling table section to the upper portion of the refrigeration unit;

an upper portion positioned between the front portion and the rear portion, positioned above the cooling table section, and defining a circumferential opening in which a plurality of storage containers is positioned;

a lower region distal from and below the upper portion and positioned below the cooling table section, the lower region configured for food storage; and an evaporator section proximate to a rear portion and configured to deliver air to the cooling table section;

circulating air from the evaporator section into the plenum of the cooling table section; and forcing air from the plenum of the cooling table section to the upper portion of the refrigeration unit through the holes defined in the upper cooling table component and towards the plurality of storage containers positioned within the circumferential opening of the upper portion, the plenum directing air directly upwards towards a one of the plurality of storage containers positioned within the forwardmost portion of the circumferential opening of the refrigeration unit.

17. The method of claim 16, wherein the lower region is in communication with the upper portion by a plenum defined between a front edge of the cooling table section and a door positioned proximate to the front portion and configured to give a user access to the upper portion and the lower region.

18. The method of claim 17, further comprising circulating air from the upper portion of the refrigeration unit to the lower region of the refrigeration unit through the plenum defined between the front edge of the cooling table section and the door so as to cool food stored in the lower region of the refrigeration unit.

19. The method of claim 16, further comprising circulating air from the lower region of the refrigeration unit to the evaporation section of the refrigeration unit.

20. The method of claim 16, further comprising:

removing the upper cooling table component; and cleaning the lower cooling table component.

* * * * *